US005901400A

United States Patent [19]

Fulop

[11] Patent Number: 5,901,400

[45] Date of Patent: May 11, 1999

[54] BRUSHING APPARATUS

[75] Inventor: Robert J. Fulop, Fairview Park, Ohio

[73] Assignee: Omni Technical Products, Inc., Cleveland, Ohio

[21] Appl. No.: 08/831,563

[22] Filed: Apr. 9, 1997

[51] Int. Cl.[6] ..... A47L 15/00; B08B 01/02

[52] U.S. Cl. ..... 15/88; 155/88.3

[58] Field of Search ..... 15/88, 88.2, 88.3, 15/77, 308, 97.1

[56] References Cited

U.S. PATENT DOCUMENTS

| | | | |
|---|---|---|---|
| 2,117,651 | 5/1938 | Caugherty . | |
| 2,767,413 | 10/1956 | Herrington | 15/77 |
| 3,258,804 | 7/1966 | Fowle | 15/88 |
| 4,373,297 | 2/1983 | Pennertz et al. | 51/84 |
| 4,382,308 | 5/1983 | Curcio | 15/77 |
| 4,406,029 | 9/1983 | Kunz | 15/77 |
| 4,955,106 | 9/1990 | Stein et al. | 15/335 |
| 5,229,817 | 7/1993 | Lange et al. | 355/209 |
| 5,475,889 | 12/1995 | Thrasher et al. | 15/88.3 |

FOREIGN PATENT DOCUMENTS

| | | | |
|---|---|---|---|
| 2234641 | 1/1974 | Germany | 15/242 |

OTHER PUBLICATIONS

Pamphlet by Comerfisam S. A. entitled "Construcciones Mecanicas FISAM", publication date unknown but prior to Jan. 1, 1997, one page.

Pamphlet by Kark Furh KG Maschinenfabrik entitled "Fuhr Information 6", publication date unknown but prior to Jan. 1, 1997, two pages.

Pamphlet by Karl Fuhr KG Maschinenfabrik entitled "Fuhr Information 6.1", publication date unknown but prior to Jan. 1, 1997, two pages.

Pamphlet by Tainan Cheng I Machinery Co., Ltd. entitled "Cheng I Machinery, Wire Descaling", publication date unknown but prior to Jan. 1, 1997, one page.

*Primary Examiner*—Mark Spisich
*Assistant Examiner*—Andrew Aldag
*Attorney, Agent, or Firm*—Tarolli, Sundheim, Covell, Tummino & Szabo

[57] ABSTRACT

An apparatus for brushing an elongated workpiece as the workpiece moves through the apparatus is particularly useful in removing scale from a rod. The apparatus includes a plurality of brushes which are engageable with the rod. Motors are provided to rotate the brushes. A detector detects the occurrence of brush wear during brushing of the rod. In order to automatically compensate for brush wear, a brush adjustment assembly changes the positions of the brushes relative to the rod in response to the detector detecting the occurrence of brush wear. When a predetermined maximum permissible amount of brush wear is detected, the brushes are automatically retracted away from the workpiece by the brush adjustment assembly. The brush adjustment assembly moves the brushes relative to the workpiece in directions perpendicular to the axes about which the brushes rotate and perpendicular to a longitudinal central axis of the workpiece. During setting up of the apparatus to brush the workpiece, the brush adjustment assembly is operable to change the positions of the brushes to equalize torque loads which are applied to the motors which rotate the brushes.

47 Claims, 9 Drawing Sheets

BRUSHING APPARATUS

BACKGROUND OF THE INVENTION

The present invention relates to a new and improved automatically controlled apparatus for continuously cleaning the periphery of an elongated workpiece as the workpiece moves through the apparatus. Although it is contemplated that the apparatus may be utilized to clean many different types of workpieces using many different types of cleaning media, the apparatus is particularly useful in removing residual scale, red rust and secondary scale by brushing a hot-rolled steel rod prior to movement of the rod through a wire drawing die.

A known apparatus for use in cleaning scale from metal rods is disclosed in U.S. Pat. No. 2,117,651. This apparatus includes a pair of brushes which are rotated about axes which extend parallel to the longitudinal central axis of the rod. While the brushes are being rotated about axes which extend parallel to the longitudinal central axis of the rod, the brushes are rotated around the rod. The known apparatus has no way to compensate for brush wear during a brushing operation.

Another known rod brushing apparatus includes a plurality of brushes which rotate about axes which are skewed at acute angles relative to the longitudinal central axis of the rod. Gauges indicative of brush wear are associated with the brushes. When an operator of the apparatus checks the gauges and notices that one or more of the brushes has become worn, the operator manually moves the brushes relative to the rod to compensate for the wear. However, if the operator is busy with other duties, a considerable length of the rod may move past the worn brushes before the operator realizes that the brushes have become worn.

SUMMARY OF THE INVENTION

It should be understood that the present invention is directed to surface enhancement of a workpiece and particularly to the removal of imperfections from the surface of a workpiece. The invention is particularly directed to the removal of hot rolled scale, red rust, secondary scale and any other type of iron oxide from a hot rolled steel rod. In this application where there is a discussion of scale removal, the discussion is equally applicable to any surface enhancement of a workpiece.

Also, it should be understood that the subject application refers to "brush", "brushes", "brushing", "brushed", etc. By such language, brushes with bristles, each brush having an abrasive surface area contact circumferentially around the workpiece, are contemplated. Also, other types of cleaning tools are contemplated, such as a rotatable abrasive wheel which would provide an abrasive surface area contact circumferentially around the workpiece. Applicant's do not contemplate use of tools which have a line or point contact with the workpiece.

The present invention provides a new and improved apparatus which includes a plurality of brushes which engage a circumferentially extending surface area around a workpiece and brush the area. The brushes are located to brush the entire circumference of the workpiece. The force of the brushes against the workpiece is monitored, and the brushes are moved relative to the workpiece to maintain a desired force.

Also, the present invention provides a new and improved apparatus which includes a plurality of brushes which are rotated to brush a workpiece. A detector is provided to detect brush wear during brushing of the workpiece. To automatically compensate for brush wear, an adjustment assembly changes the positions of the brushes relative to the workpiece in response to the detector detecting brush wear. When a predetermined maximum permissible extent of brush wear has occurred, the brushes are automatically moved away from the workpiece to interrupt the brushing operation.

The brushes are rotatable about axes which extend parallel to the longitudinal central axis of the workpiece. The brush adjustment assembly moves each of the brushes relative to the workpiece in a direction perpendicular to the axis about which the brush rotates. During setting up of the apparatus to brush a workpiece, the brush adjustment assembly may be operated to change the positions of the brushes to equalize torque loads which are applied to motors which drive the brushes.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
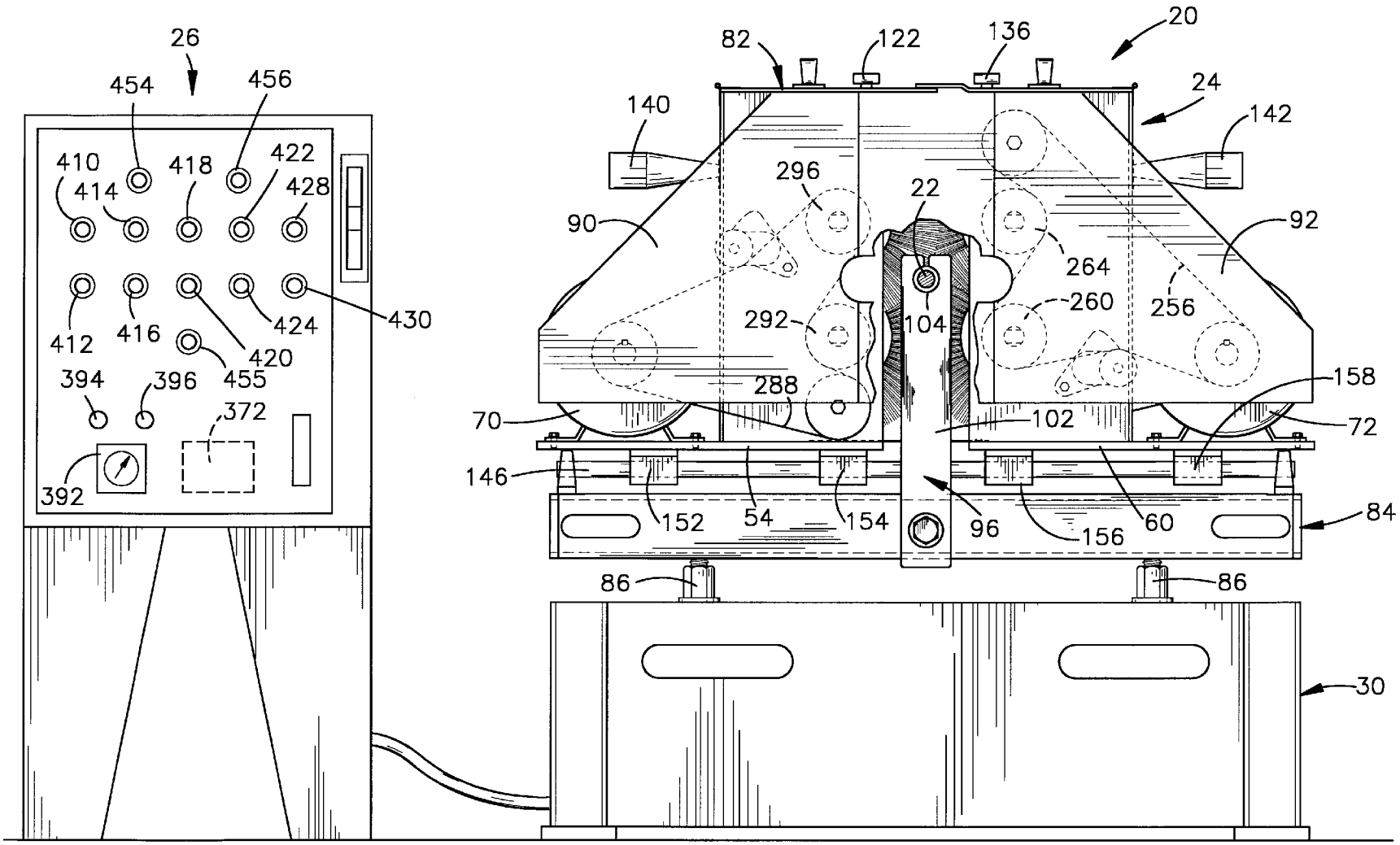
FIG. 1 is a front elevational view of an apparatus constructed in accordance with the present invention to brush an elongated workpiece as the workpiece moves through the apparatus.

An apparatus 20 (FIG. 1) is used to brush a longitudinally extending side of an elongate workpiece or rod 22 as the rod moves through the apparatus. The apparatus 20 includes a brushing machine 24 and controls 26 for the brushing machine. Although it is contemplated that the brushing machine 24 could be utilized to brush many different workpieces, the brushing machine is advantageously utilized to brush iron oxide scale from the metal rod 22 prior to drawing of the rod through a die.

Before entering the brushing machine 24, the metal rod 22 passes through breaking rolls (not shown) which deform the rod to crack and loosen the scale and other surface impurities on the rod in a known manner. A suitable mechanism (not shown) then pulls the rod 22 through the brushing machine 24 in the manner indicated by arrows 28 in FIGS. 3 and 5. It should be understood that the brushing machine 24 (FIG. 1) could be utilized for purposes other than brushing scale from a metal rod.

The brushing machine 24 includes a base 30 (FIG. 1) and a plurality of circular wire brushes 32, 34, 36, 38, 40, 42, 44 and 46 (FIGS. 2, 3, 4 and 5). The wire brushes 32–46 (FIG. 5) are rotatable about axes which extend parallel to a longitudinal central axis of the metal rod 22. In order to adjust the force with which the wire brushes 32–46 engage the cylindrical outer side of the rod 22 and to compensate for brush wear, the wire brushes are movable toward and away from the rod along paths extending perpendicular to the longitudinal central axis of the rod and to the axes of rotation of the wire brushes.

Figure 2:
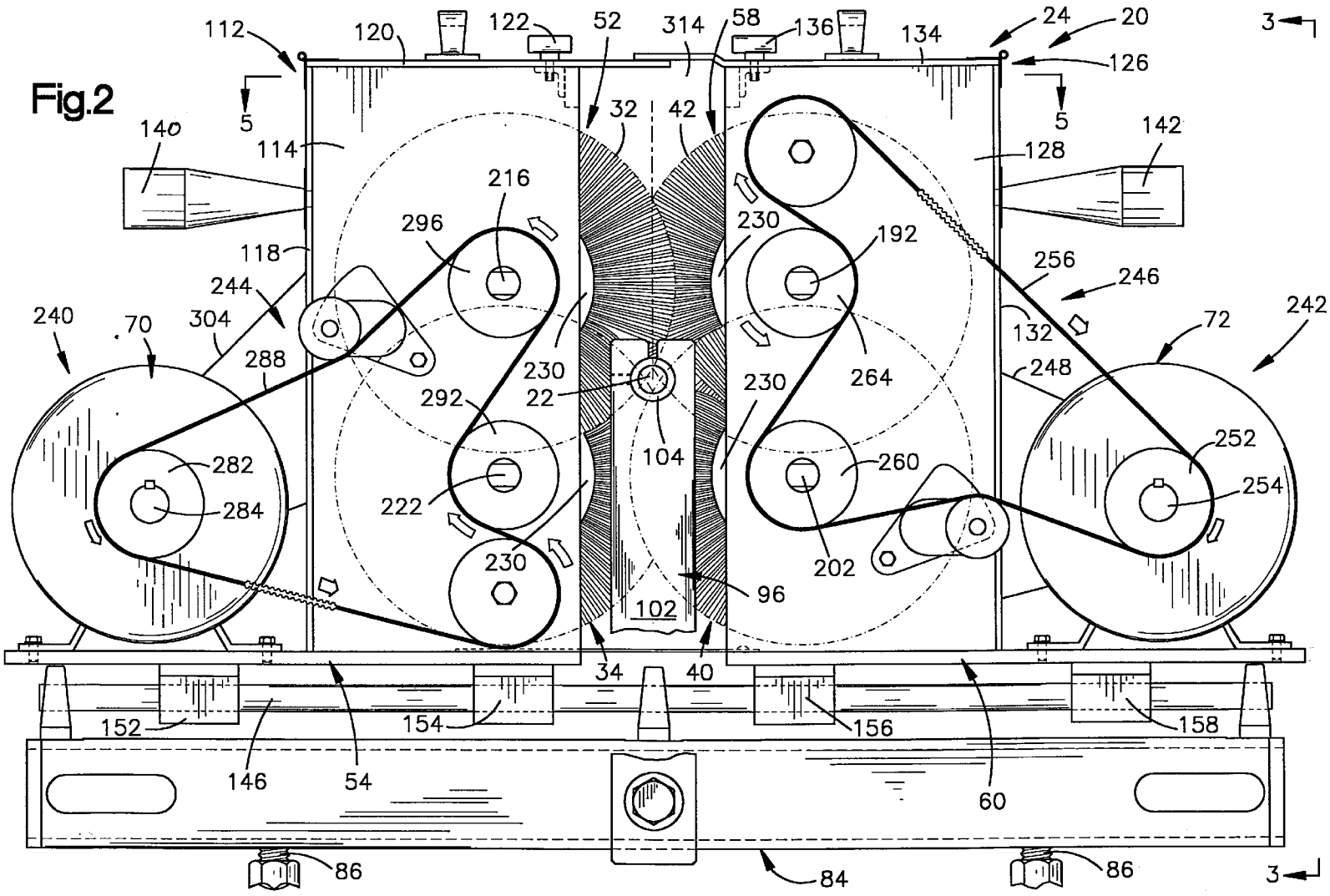
FIG. 2 is an enlarged schematic front elevational view of a portion of the apparatus of FIG. 1, with guards removed to illustrate the manner in which motors are utilized to drive brushes in the apparatus.
Figure 4:
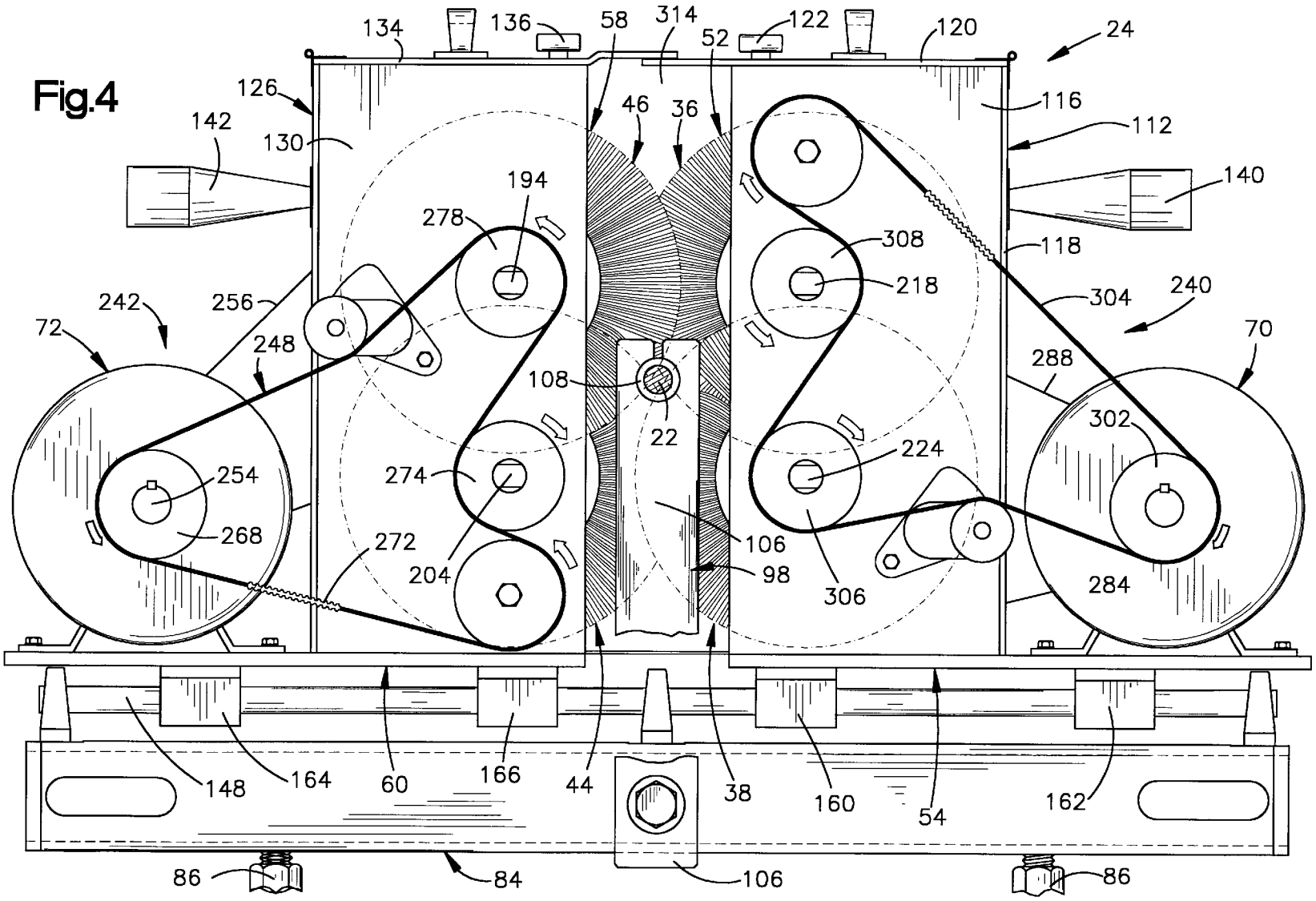
FIG. 4 is a schematic rear elevational view, taken generally along the line 4—4 of FIG. 3.

A first or left group 52 (FIGS. 2, 4 and 5), of wire brushes are mounted on a first or left carriage 54 (FIG. 2). The left carriage 54 is movable toward and away from the rod 22 along a path extending perpendicular to a longitudinal central axis of the rod. Since FIG. 4 is a rear view of the brushing machine 24, the left carriage 54 appears in the right portion of FIG. 4.

A second or right group 58 (FIGS. 2, 3, 4 and 5) of brushes is mounted on a second or right carriage 60 (FIG. 2). The right carriage 60 is movable toward and away from the rod 22 along a path extending perpendicular to the longitudinal central axis of the rod 22. Since FIG. 4 is a rear view of the brushing machine 24, the right carriage 60 appears in the left portion of FIG. 4.

The wire brushes 32–38 in the left group 52 of brushes (Fig. 5) are supported on the left carriage 54 (FIG. 2) for rotation about axes which are parallel to the central axis of the rod 22. Similarly, the wire brushes 40–46 (FIG. 5) in the right group 58 of wire brushes are supported on the right carriage 60 (FIG. 2) for rotation about axes which are parallel to the longitudinal central axis of the rod 22.

Figure 6:
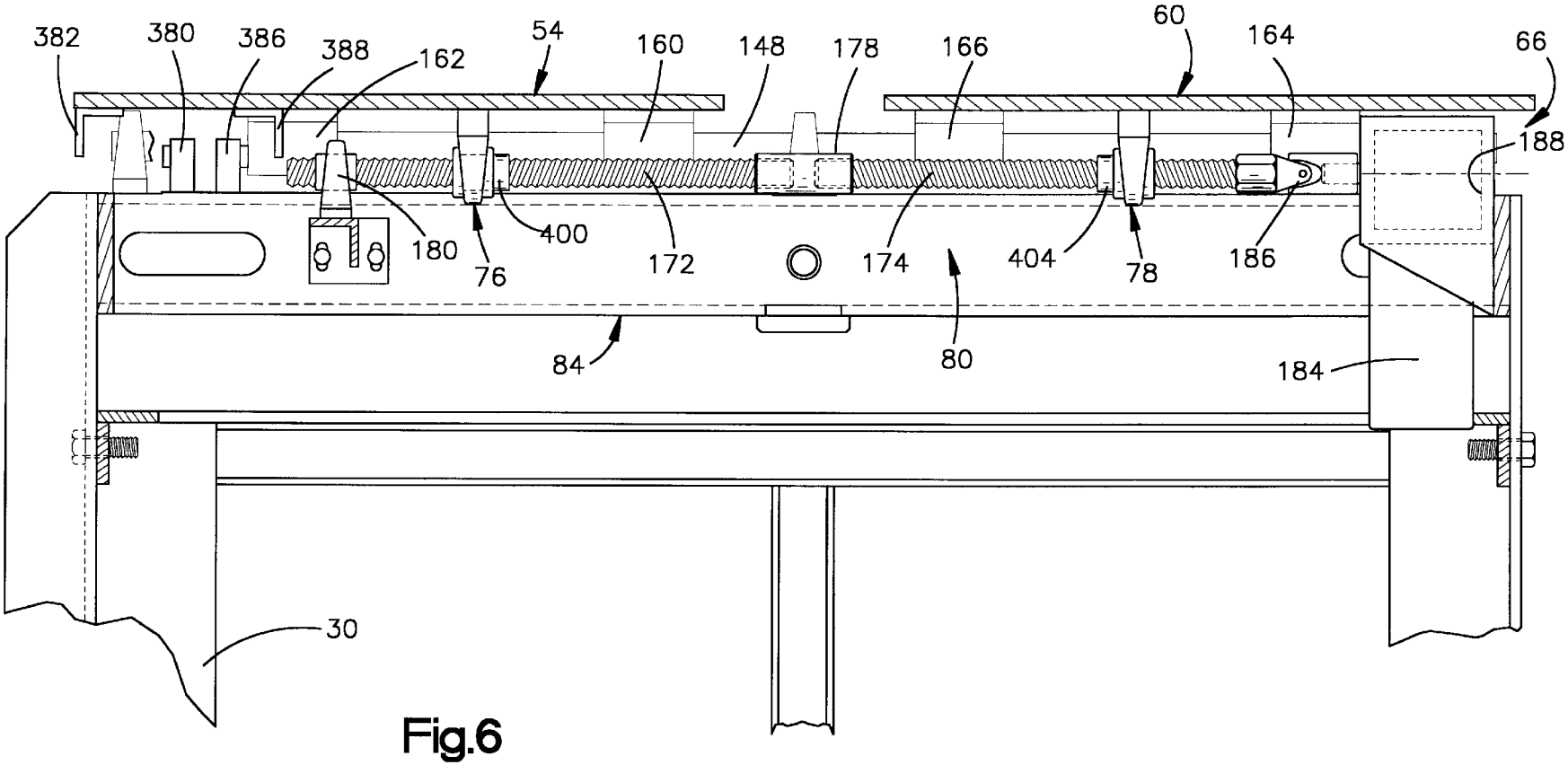
FIG. 6 is a sectional view, taken generally along the line 6—6 of FIG. 5, illustrating a drive assembly for a pair of carriages on which the brushes are mounted.

The left and right carriages 54 and 60 are simultaneously movable toward and away from each other by a carriage drive assembly 66 (FIG. 6). The carriage drive assembly 66 is operable to simultaneously move the left and right carriages 54 and 60 (FIG. 2) and the left and right groups 52 and 58 of brushes toward or away from each other. Movement of the left and right carriages 54 and 60 toward the rod 22 moves the left and right groups 52 and 58 of brushes from retracted positions spaced from the rod 22 to extended positions engaging the rod 22. Movement of the left and right carriages 54 and 60 away from the rod 22 moves the left and right groups 52 and 58 of brushes from the extended positions back to the retracted positions.

The wire brushes 32–38 (FIG. 5) in the left group 52 of brushes are rotated by a left brush drive motor 70 (FIG. 2). The left brush drive motor 70 is disposed on the left carriage 54 and is movable with the left group 52 of brushes relative to the rod 22. Similarly, the wire brushes 40–46 (FIG. 5) in the right group 58 of brushes are rotated by a right brush drive motor 72 (FIG. 2). The right brush drive motor 72 is disposed on the right carriage 60 and is movable with the right group 58 of brushes relative to the rod 22.

In accordance with one of the features of the invention, the controls 26 (FIG. 1) for the brushing machine 24 monitor the force applied by the brushes to the workpiece and maintain the force at a predetermined force. This automatically compensates for wear of the wire brushes 32–46. As the wire brushes 32–46 wear during brushing of the rod 22, the controls 26 effect operation of the carriage drive assembly 66 (FIG. 6) to simultaneously move the left and right carriages 54 and 60 (FIG. 2) toward the rod 22. In order to maintain substantially uniform brush pressure against the outer periphery of the rod 22, the controls 26 (FIG. 1) are effective to maintain a substantially constant torque load on the left and right brush drive motors 70 and 72 during brushing of the rod 22.

In accordance with another feature of the invention, the controls 26 (FIG. 1) interrupt a brushing operation when the wire brushes 32–46 (FIG. 5) have been worn to a predetermined maximum permissible extent. Thus, when the controls 26 detect that the wire brushes 32–46 have been worn to the maximum permissible extent, the left and right carriages 54 and 60 (FIG. 2) are retracted by the carriage drive assembly 66 to move the left and right groups 52 and 58 of brushes away from the rod 22.

In accordance with another feature of the invention, the forces applied by the left and right groups 52 and 58 of brushes against the rod 22 are equalized during setting up of the brushing machine 24. Thus, during setting up of the brushing machine 24 to brush the rod 22, the controls 26 (FIG. 1) are operable to detect a difference in the force with which the wire brushes 32–38 of the left group 52 of brushes are pressed against the rod and the force with which the wire brushes 40–46 of the right group 58 of brushes are pressed against the rod. A left adjustment mechanism 76 (FIG. 6) is operable to adjust the position of the left carriage 54 relative to the rod 22. A right adjustment mechanism 78 is operable to adjust the position of the right carriage 60 relative to the rod 22. The adjustment mechanisms 76 and 78 are manually actuatable to change the position of the left and right groups 52 and 58 of brushes relative to each other to thereby equalize the forces applied against the rod 22 by the wire brushes 32–46.

The carriage drive assembly 66 and brush adjustment mechanisms 76 and 78 combine with the controls 26 to form a brush adjustment assembly 80 (FIG. 6) which is operable to compensate for brush wear and to equalize brush loads. During operation of the apparatus 20, the controls 26 effect automatic operation of the carriage drive assembly 66 to compensate for wear of the wire brushes 32–46. During setting up of the apparatus 20, the adjustment mechanisms 76 and 78 are manually operated to equalize the force which the brushes 32–46 apply against the workpiece. If desired, suitable motors could be connected with the adjustment mechanisms 76 and 78 to enable the controls 26 to automatically adjust the positions of the brushes 32–46 to equalize forces on the brushes.

Housing and Support Structure

The wire brushes 32–46 (FIG. 5) are enclosed by a housing structure 82 (FIG. 1). The housing structure 82 includes the base 30. In addition, the housing structure 82 includes a support frame 84 which is vertically movable relative to the base 30 to adjust the height of the brushing machine 24. The support frame 84 is connected with the base 30 by a plurality of adjustment screws 86. It should be understood that although only two adjustment screws 86 have been shown in FIG. 1, four height adjustment screws are disposed between the support frame 84 and the base 30.

The housing structure 82 also includes left and right guards 90 and 92 (FIG. 1). The guard 90 is connected with the left carriage 54 and is movable with the left carriage relative to the support frame 84. Similarly, the right guard 92 is connected with the right carriage 60 and is movable with the right carriage 60 relative to the support frame 84. The guards 90 and 92 have been removed from the brushing machine 24 in FIGS. 2–7, in order to better illustrate the construction of the brushing machine.

The rod 22 is at least partially supported in the brushing machine 24 by a front guide 96 (FIGS. 1 and 2) and a rear guide 98 (FIG. 4). The front guide 96 includes an upstanding support member 102 on which an annular guide ring 104 (FIG. 2) is mounted. Similarly, the rear guide 98 (FIG. 4) includes an upstanding support member 106 on which an annular guide ring 108 is mounted. A known rod pulling mechanism (not shown) pulls the rod 22 through the guide rings 104 and 108 in the direction indicated by arrows 28 in FIGS. 3 and 5.

Figure 5:
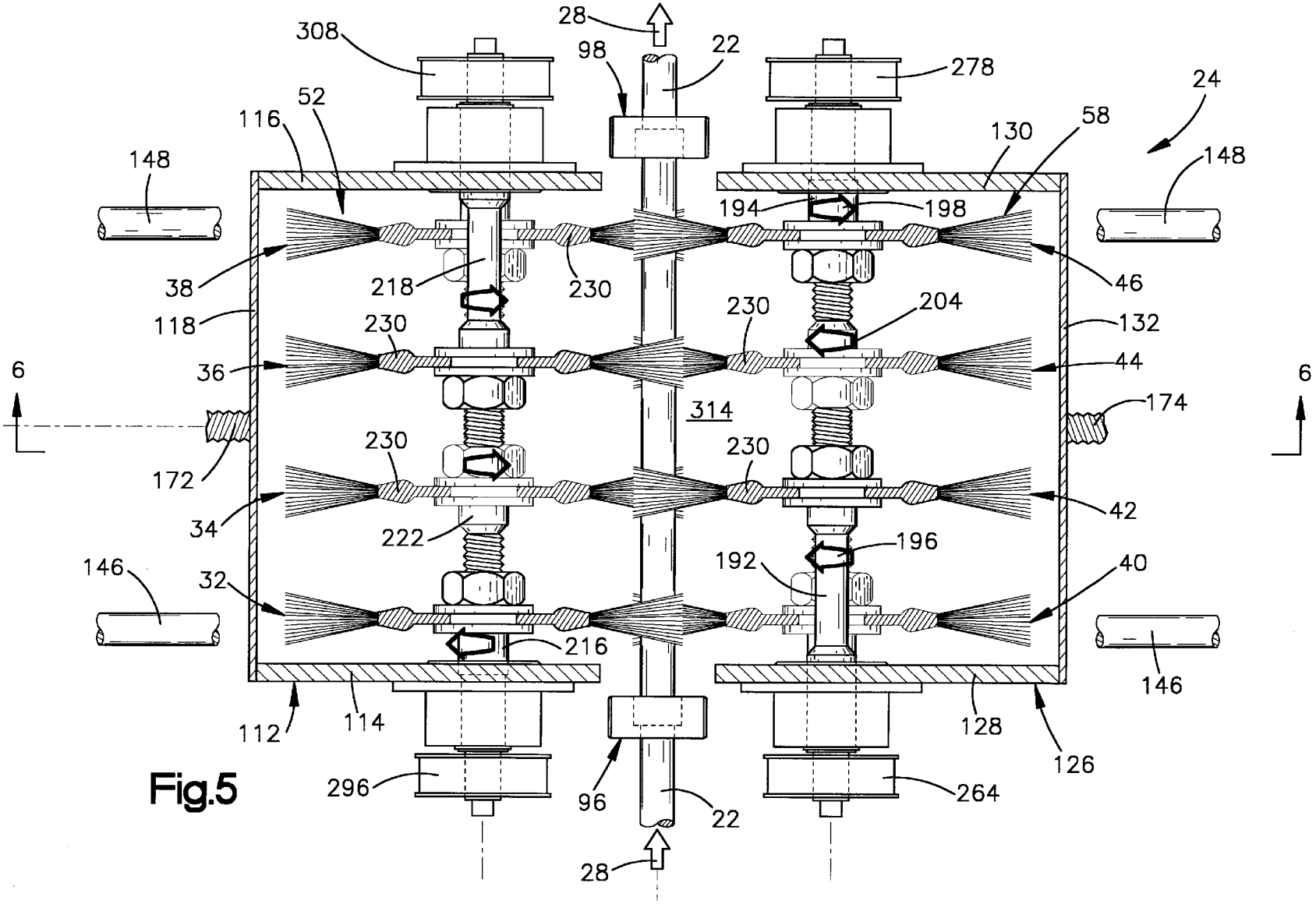
FIG. 5 is a schematic sectional view, taken generally along the line 5—5 of FIG. 2, further illustrating the relationship of the brushes to the workpiece.

A left housing subassembly 112 (FIG. 2) encloses and supports the left group 52 of wire brushes 32–38 on the left carriage 54 (FIGS. 2 and 5). The left housing subassembly 112 has a rectangular configuration and includes a front side wall 114 (FIG. 2), a rear side wall 116 (FIG. 5) and an end wall 118. The end wall 118 extends between and is perpendicular to the front and rear side walls 114 and 116. The front and rear side walls 114 and 116 and the end wall 118 are fixedly connected with the left carriage 54 (FIG. 2).

An access cover 120 (FIG. 2) is pivotally connected to the end wall 116. The access cover 120 is releasably connected with the front side wall 114 by a manually actuatable latch 122. By pivoting the cover 120 in a counterclockwise direction from the closed position shown in FIG. 2, access is provided to the left group 52 of wire brushes.

A right housing assembly 126 has the same general construction as the left housing assembly 112 and encloses and supports the right group 58 of wire brushes 40–46 (FIG. 5). The right housing assembly 126 includes a front side wall 128 and a rear side wall 130 (FIG. 5) which extends parallel to the front side wall 128. An end wall 132 extends between and is perpendicular to the front and rear side walls 128 and 130. The front and rear side walls 128 and 130 and end wall 132 are fixedly connected to the right carriage 60 (FIG. 2).

An access cover 134 (FIG. 2) is pivotally connected to the end wall 132. A latch 136 is manually releasable to enable the cover 134 to be pivoted in a clockwise direction (as viewed in FIG. 2) from the closed position to an open position. When the cover 134 is in an open position, the right group 58 of wire brushes 40–46 are accessible.

A pair of suction nozzles 140 and 142 (FIG. 2) are fixedly connected to the end walls 118 and 132. The nozzles 140 and 142 are connected with a source of suction or low pressure. During a brushing operation, a flow of fluid (air) with particles of scale and/or other materials entrained therein, is drawn from the work area around the left and right groups 152 and 158 of wire brushes into the nozzles 140 and 142. The flow of fluid (air) and entrained particles is conducted to a suitable location for disposal of the particles.

The left and right carriages 54 and 60 are slidably supported by a cylindrical front guide bar 146 (FIG. 2) and a cylindrical rear guide bar 148 (FIG. 4). The front and rear guide bars 146 and 148 are disposed in a parallel relationship and are fixedly connected with the support frame 84. The front and rear guide bars 146 and 148 have longitudinal central axes which extend perpendicular to the central axis of the rod 22. The wire brushes 32–46 (FIG. 5) are rotatable about axes which extend perpendicular to the longitudinal central axis of the guide bars 146 and 148.

Left front bearing assemblies 152 and 154 (FIG. 2) slidably connect the left carriage 54 with the front guide bar 146. Similarly, the right carriage 60 is slidably connected with the front guide bar 146 by right front bearing assemblies 156 and 158. Left rear bearing assemblies 160 and 162 (FIG. 4) connect the left carriage 54 with the rear guide bar 148. Similarly, right rear bearing assemblies 164 and 166 slidably connect the right carriage 60 with the rear guide bar 148. The carriage drive assembly 66 is operable to cause the bearing assemblies 152–166 to slide along the front and rear guide bars 146 and 148 to guide movement of the left and right carriages 54 and 60 relative to the base 30.

Carriage Drive Assembly

The carriage drive assembly 66 (FIG. 6) is connected with the left and right carriages 54 and 60. The carriage drive assembly 66 is operable to simultaneously cause the carriages 54 and 60 to either move toward each other or to move away from each other. This movement of the left and right carriages 54 and 60 is guided by the front and rear guide bars 146 and 148.

Although the carriage drive assembly 56 could have many different constructions, in the illustrated embodiment of the invention, the carriage drive assembly 66 includes a left hand screw 172 (FIG. 6) and a righthand screw 174. The left and righthand screws 172 and 174 have coincident longitudinal central axes which extend parallel to the longitudinal central axes of the front and rear guide bars 146 and 148 (FIGS. 2 and 4). The longitudinal central axes of the lefthand screw 172 and righthand screw 174 extend perpendicular to the longitudinal central axis of rod 22.

The lefthand and righthand drive screws 172 and 174 are fixedly connected by a coupling 178. The left end of the lefthand screw 172 (FIG. 6) is rotatably supported by a suitable bearing on a bracket 180. The opposite or right end of the righthand screw 174 is connected with a carriage drive motor 184 through a universal joint 186 and a right angle drive assembly 188. The carriage drive motor 184 is a reversible electric motor and is operable in one direction to simultaneously rotate the left and righthand screws 172 and 174 to cause drive threads on the screws to move the carriages 54 and 60 toward each other. The carriage drive motor 184 is operable in an opposite direction to rotate the left and righthand drive screws 172 and 174 to cause the drive threads on the screws to move the carriages 54 and 60 away from each other.

In the illustrated embodiment of the invention, a single carriage drive motor 184 is provided to drive the left and right carriages 54 and 60. However, if desired, separate carriage drive motors could be used to move the carriages 54 and 60 along the guide bars 146 and 148. If this was done, a first carriage drive motor would be connected with the screw 72 and a second carriage drive motor would be connected with the screw 174. The two screws 172 and 174 would be separately driven and would not be interconnected by the coupling 178. If desired, a chain drive system or a gear drive system could be utilized in place of the illustrated screw drive system.

Wire Brushes and Mountings

The wire brushes 32–38 of the left group 52 of brushes (FIG. 5) are mounted on the left housing subassembly 112 for rotation about parallel axes. Similarly, the wire brushes 40–46 of the right group 58 of brushes are rotatably mounted on the housing subassembly 126 for rotation about parallel axes. The axes about which the wire brushes 32–46 are rotatable extend parallel to each other and to the longitudinal central axis of the rod 22. The front and rear guide rods 146 and 148 extend perpendicular to the axes about which the wire brushes 32–46 rotate.

Figure 3:
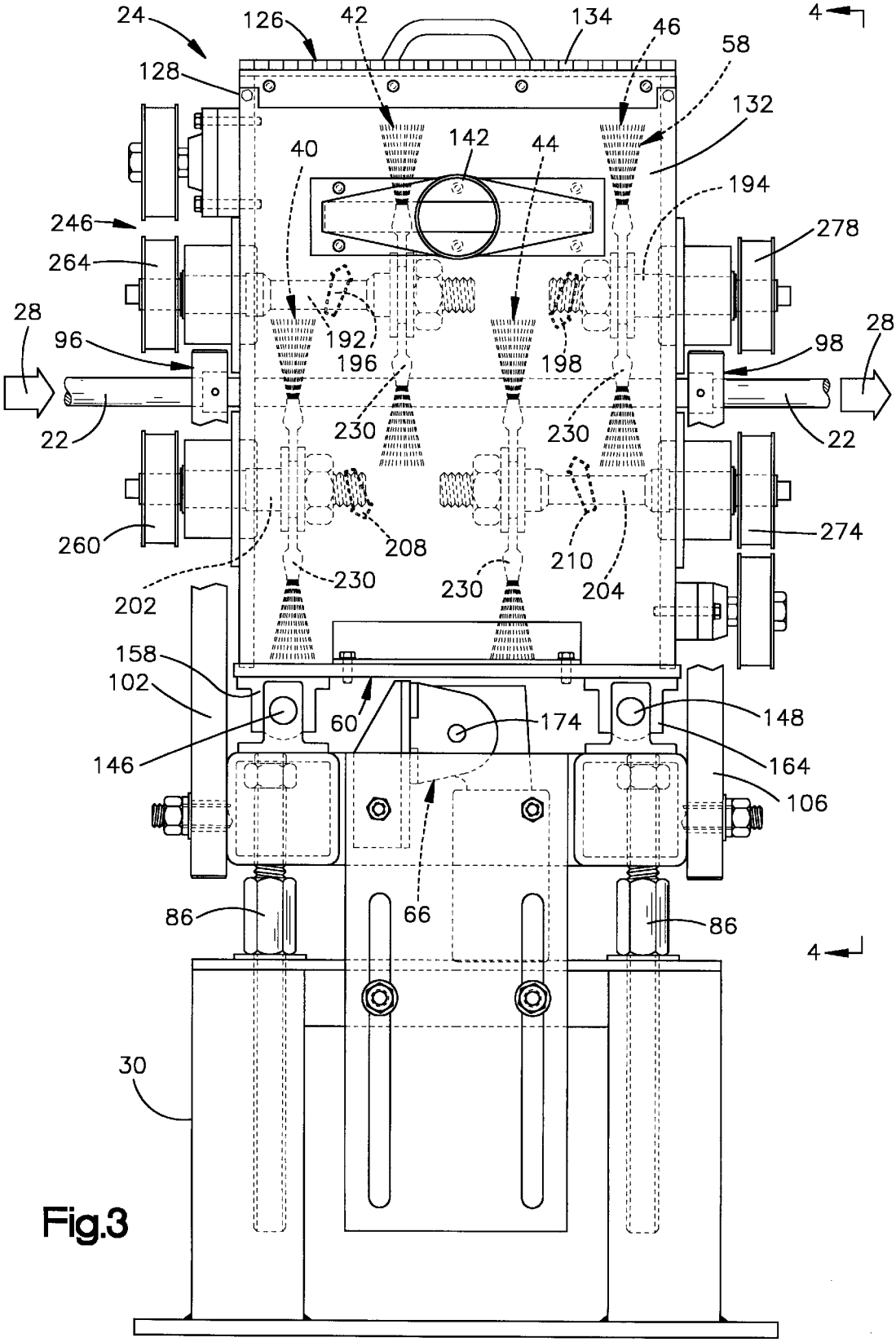
FIG. 3 is a schematic side elevational view, taken generally along the line 3—3 of FIG. 2, further illustrating the brushes.

The right group 58 of brushes includes the upper right front wire brush 42 which is rotatably mounted on a long support shaft or spindle 192 (FIGS. 3 and 5). The upper right rear wire brush 46 is rotatably mounted on a short support shaft or spindle 194. The long support shaft 192 and short support shaft 194 have coincident central axes. The coincident central axes of the long and short support shafts 192 and 194 extend parallel to a longitudinal central axis of the rod 22.

The right brush drive motor 72 (FIGS. 2 and 4) is operable to rotate the upper right front and rear wire brushes 42 and 46 in opposite directions. Thus, the upper right front wire brush 42 and long support shaft 192 are rotated in a counterclockwise direction as viewed in FIG. 2, that is, from the front of the brushing machine 24. Similarly, the upper right rear wire brush 46 and short support shaft 194 are rotated in a counterclockwise direction as viewed in FIG. 4, that is from the rear of the machine. As indicated by arrows 196 and 198 in FIG. 3, the long and short support shafts 192 and 194 and wire brushes 42 and 46 are being rotated in opposite directions about their coincident central axes.

The right group 58 of wire brushes includes the lower right front wire brush 40 (FIGS. 2, 3 and 5) mounted on a rotatable short support shaft or spindle 202 (FIG. 3). The lower right rear wire brush 44 is mounted on a long rotatable support shaft or spindle 204 (FIGS. 3, 4 and 5). The short and long support shafts or spindles 202 and 204 have coincident central axes. The coincident central axes of the short and long support shafts 202 and 204 extend parallel to the longitudinal central axis of the rod 22.

The right brush drive motor 72 (FIGS. 2 and 4) is operable to rotate the lower right front wire brush 40 and lower right rear wire brush 44 in opposite directions. Thus, the lower right front wire brush 40 and the short support shaft 202 rotate in a clockwise direction as viewed in FIG. 2, that is, from the front of the brushing machine 24. Similarly, the lower right rear wire brush 44 and long support shaft 204 rotate in a clockwise direction as viewed in FIG. 4, that is, from the rear of the brushing machine 24. The direction of rotation of the lower right front wire brush 40 and short shaft 202 is indicated by the arrow 208 in FIG. 3. Similarly, the direction of rotation of the lower right rear wire brush 44 and long support shaft 204 is indicated by the arrow 210 in FIG. 3.

The use of the long support shafts 192 and 204 and the short support shafts 94 and 202 for the wire brushes 40–46 prevents interference between the wire brushes (FIGS. 3 and 5). The adjacent right front upper and lower wire brushes 42 and 40 rotate in opposite directions, as indicated by the arrows 196 and 208 in FIG. 3. Similarly, the upper and lower right rear wire brushes 46 and 44 rotate in opposite directions, as indicated by the arrows 198 and 210 in FIG. 3.

The left group 52 of wire brushes 32–38 (FIG. 5) is mounted in a manner which is similar to the manner in which the right group 58 of wire brushes 40–46 is mounted. Thus, the left group 52 of wire brushes includes the upper left front wire brush 32 (FIGS. 2 and 5) which is mounted on a short support shaft or spindle 216. The upper left rear wire brush 36 (FIGS. 4 and 5) is mounted on a long support shaft or spindle 218. The short and long support shafts or spindles 216 and 218 have coincident central axes. The coincident central axes of the short support shaft 216 and long support shaft 218 extend parallel to a longitudinal central axis of the rod 22 (FIG. 5).

The left brush drive motor 70 rotates the upper left front and rear wire brushes 32 and 36 in opposite directions. Thus, the upper left front wire brush 32 and short support shaft 216 rotate in a counterclockwise direction as viewed in FIG. 2, that is, from the front of the brushing machine 24. Similarly, the upper left rear wire brush 36 and long support shaft 218 rotate in a counterclockwise direction as viewed in FIG. 4, that is, from the rear of the brushing machine 24.

The lower left pair of wire brushes includes the lower left front wire brush 34 (FIGS. 2 and 5) mounted on a long support shaft 222. The lower left pair of wire brushes includes a lower left rear wire brush 38 (FIG. 4) which is mounted on a short support shaft 224 (FIG. 4). The long support shaft 222 and short support shaft 224 have coincident central axes. The coincident central axes of the long support shaft 222 and the short support shaft 224 extend parallel to the longitudinal central axis of the rod 22.

The left brush drive motor 70 rotates the lower left front and rear wire brushes 34 and 38 in opposite directions. Thus, the lower left front wire brush 34 rotates in a clockwise direction, as viewed in FIG. 2. Similarly, the lower left rear wire brush 38 rotates in a clockwise direction as viewed in FIG. 4.

The parallel central axes about which the upper wire brushes 32, 36, 42, and 46 rotate are disposed in a common horizontal plane which extends parallel to and is disposed above the longitudinal central axis of the rod 22. Similarly, the parallel axes about which the lower brushes 34, 38, 40 and 44 rotate are disposed in a common horizontal plane which extends parallel to and is disposed below the longitudinal central axis of the rod 22. The horizontal planes containing the axes about which the wire brushes 32–46 rotate are disposed equal distances above and below the longitudinal central axis of the rod 22.

The parallel axes about which the left wire brushes 32, 34, 36, and 38 rotate are disposed in a common vertical plane which extends parallel to the longitudinal central axis of the rod 22. Similarly, the axes about which the right wire brushes 40, 42, 44 and 46 rotate are disposed in a vertical plane which extends parallel to the central axis of the rod 22. The vertical planes containing the axes about which the wire brushes 32–46 rotate are disposed equal distances on opposite sides of the central axis of the rod 22.

The upper left wire brushes 32 and 36 and the lower right wire brushes 40 and 44 rotate about axes which are disposed in a plane containing the central axis of the rod 22. Similarly, the lower left wire brushes 34 and 38 and the upper right wire brushes 42 and 46 rotate about axes which are disposed in a plane containing the central axis of the rod 22.

The wire brushes 32–46 (FIG. 5) all have the same construction. Each of the wire brushes 32–46 is circular and has an annular hub 230 which is fixedly connected to either a long or a short support shaft or spindle by a retaining nut. To prevent loosening of the retaining nuts, the retaining nuts and shafts have threads of a hand or direction which tend to cause the nuts to tighten under the influence of operating loads. Thus, the supports shafts which rotate in a clockwise direction, as viewed from the drive end of the shaft, have righthand threads. The support shafts which rotate in a counterclockwise direction, as viewed from the drive end of the shaft, have lefthand threads.

Figure 7:
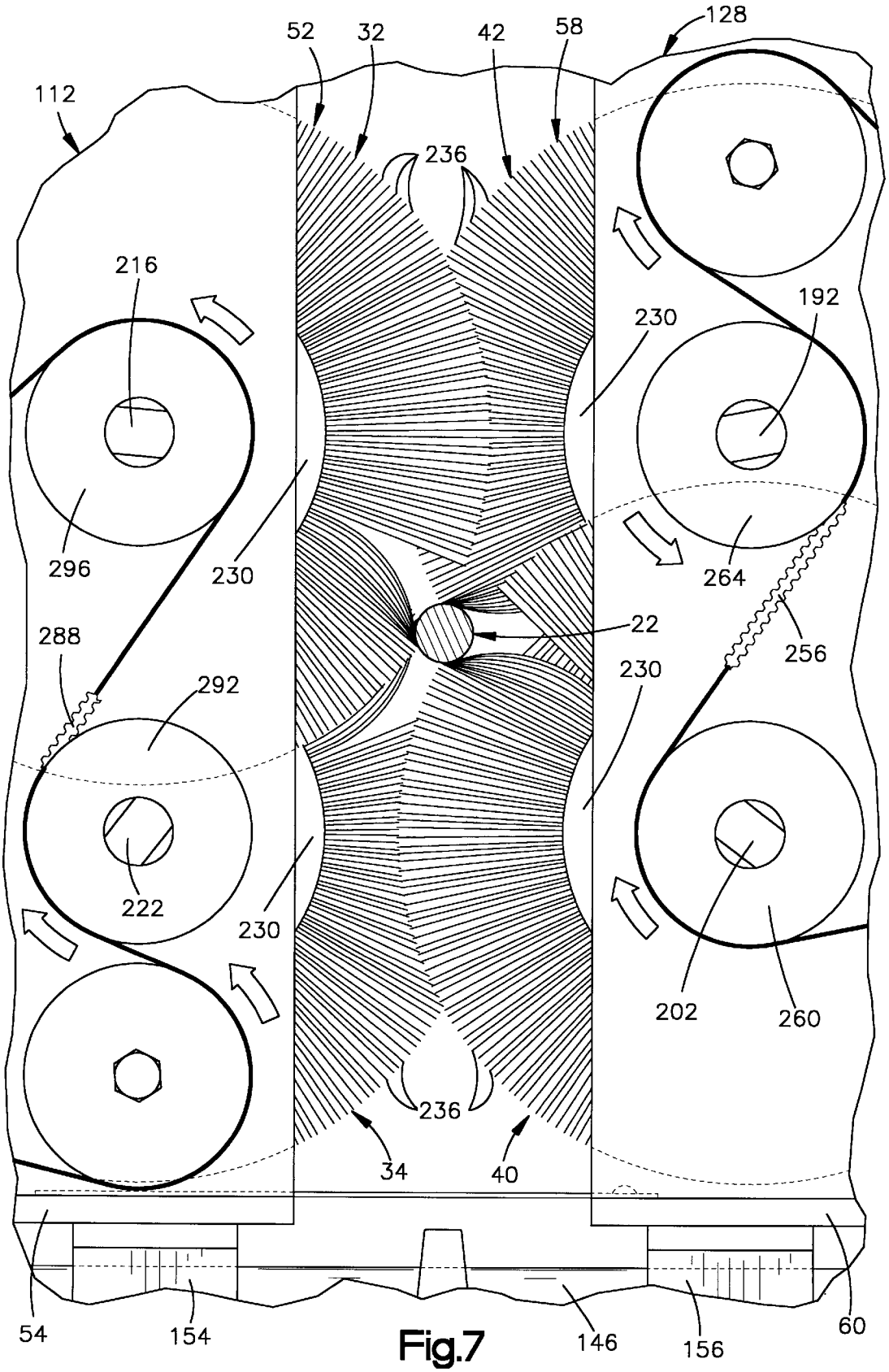
FIG. 7 is an enlarged simplified illustration schematically depicting the manner in which the brushes engage the workpiece.

The wire brushes 32–46 have bristles 236 (FIG. 7) which extend radially outward from the hubs 230. The bristles 236 are conventional twisted and knotted bristles having a central reinforcing stem. Although this design is preferred since it appears to provide a relatively long operating life, it should be understood that wire brushes having a different design could be utilized if desired. It should be understood that FIG. 7 is a simplified schematic illustration of the bristles 236 and the manner in which the bristles engage the rod 22.

In one specific embodiment of the invention, the bristles 236 of the wire brushes 32–46 are disposed in an array having a maximum of about a twelve inch diameter and about a 1.5 inch axial extent. After being used to brush a relatively long length of rod 22, the brushes 32–46 were worn away to about 9 inch minimum diameter before being replaced. It should be understood that the foregoing specific description of the brushes 32–46 has been set forth herein for purposes of clarity of description and it is contemplated that the brushes 32–46 could have a different construction if desired.

Wire Brush Drive

The wire brushes 32–46 are driven by similar left and right brush drive systems 240 and 242 (FIGS. 2 and 4). The left and right brush drive systems 240 and 242 are mounted on the left and right carriages 54 and 60. Therefore, the drive systems 240 and 242 move relative to the rod 22 with the wire brushes 32–46. This results in the relationship between the drive systems 240 and 242 and the wire brushes 32–46 remaining constant during movement of the left and right carriages 54 and 60 relative to the rod 22.

The right brush drive system 242 includes a single electric motor 72. The motor 72 is connected with the right front brushes 40 and 42 by a right front drive train 246 (FIG. 2). The right brush drive motor 72 is connected with the right rear brushes 44 and 46 by a right rear drive train 248 (FIG. 4).

The right front drive train 246 (FIG. 2) includes a front drive pulley 252 which is fixedly connected with an output shaft 254 of the right brush drive motor 72. The output shaft 254 of the right brush motor 72 rotates in a clockwise direction as viewed in FIG. 2, that is, from the front of the brushing machine 24. A front drive belt 256 is driven by the,front drive pulley 252.

The front drive belt 256 drives a pulley 260 connected to the short lower front support shaft 202 and the lower right front wire brush 40 in a clockwise direction, as viewed in FIG. 2. The front drive belt 256 drives a pulley 264 connected to the long upper front support shaft 192 and the upper right front wire brush 42 in a counterclockwise direction as viewed in FIG. 2. The front drive belt 256 is advantageously toothed on both sides to enable the belt to cooperate with the pulleys 260 and 264.

The right rear drive train 248 (FIG. 4) includes a drive pulley 268 which is fixedly connected to the end of the output shaft 254 of the right drive brush motor 72 opposite from the pulley 252. The output shaft 254 extends through the right brush drive motor 72. The output shaft 254 of the right brush motor 72 rotates in a counterclockwise direction as viewed in FIG. 4, that is, from the rear of the brushing machine 24. A rear drive belt 272 is driven by the rear drive pulley 268.

The rear drive belt 272 drives a pulley 274 connected with the lower right rear wire brush 44 and the long support shaft 204. The belt 272 drives the wire brush 44 and the long support shaft 204 in a clockwise direction as viewed, in FIG. 4, that is, as viewed from the rear of the brushing machine 24. The drive belt 272 extends around a pulley 278 which is fixedly connected to the short support shaft 194 and the upper right rear wire brush 46 (FIG. 4). The belt 272 drives the short support shaft 194 and upper wire brush 46 in a counterclockwise direction, as viewed in FIG. 4, that is from the rear of the brushing machine 24.

The left brush drive system 240 is similar to the right brush drive system 242. The left brush drive system 240 (FIG. 2) includes a front drive pulley 282 which is fixedly connected to an output shaft 284 of the left brush drive motor 70. The output shaft 284 of the left brush drive motor 70 rotates in a counterclockwise direction, as viewed in FIG. 2.

The left brush drive system 240 includes a front drive belt 288 which extends around the front drive pulley 282. The front drive belt 288 engages a pulley 292 which is connected to the long support shaft 222 and the lower left front wire brush 34. The front drive belt 288 rotates the long support shaft 222 and lower left front wire brush 34 in a clockwise direction as viewed in FIG. 2.

The left front drive belt 288 extends around a pulley 296 connected to the short support shaft 216 and the left upper front wire brush 32. The front drive belt 288 rotates the short support shaft 216 and wire brush 32 in a counterclockwise direction as viewed in FIG. 2, that is, from the front of the brushing machine 24.

The left brush drive system 240 includes a rear drive pulley 302 (FIG. 4) which is connected to a rear end portion of the output shaft 284 of the left brush drive motor 70. A rear drive belt 304 engages the rear drive pulley 302. In addition, the rear drive belt 304 engages a pulley 306 connected with the short support shaft 224 and lower rear wire brush 38. The drive belt 304 rotates the short support shaft 224 and lower left rear wire brush 38 in a clockwise direction, as viewed in FIG. 4. The left rear drive belt 304 extends around a pulley 308 connected with the long support shaft 218 and the upper left rear wire brush 36. The rear drive belt 304 rotates the long support shaft 218 and the upper left wire brush 36 in a counterclockwise direction as viewed in FIG. 4.

In the illustrated embodiment of the invention, the left and right brush drive systems 240 and 242 utilize toothed belts to transmit brush drive forces. However, it is contemplated that other known types of drive systems, such as chain or gear drive systems could be utilized. If desired, a separate drive motor could be provided for each of the wire brushes 32–46. If this was done, a separate carriage drive motor could be provided to move each of the wire brushes 32–46 and its associated drive motor relative to the rod 22. However, for cost reasons, it is believed that the carriage drive system 66 and brush drive systems 240 and 242 may be preferred.

Brushing Of Rod

During brushing of the rod 22, the entire peripheral surface of the rod is engaged by the wire brushes 32–46 (FIG. 5) as the rod 22 is pulled through the brushing machine 24. Since the entire peripheral surface of the rod 22 is engaged by the wire brushes 32–46, uniform removal of scale from the rod is promoted. Uniform scale removal from the rod 22 enables the rod to be moved into and through a drawing die to form wire with a minimum of imperfections due to scale.

During a brushing operation, the wire brushes 32–46 apply offsetting forces to the rod 22 to minimize loading of the rod by the brushing machine 24. Each of the wire brushes 32–46 (FIG. 5) wipes across a circumferentially extending surface area of the rod 22 in a stripe which also extends axially along the rod. Each stripe formed by one of the wire brushes 32–46 is defined by arcuate markings which extend essentially circumferentially around the rod.

The straight circumferentially and axially extending stripe formed by any one of the wire brushes 32–46 overlaps adjacent stripes formed by other brushes. This results in the entire surface of the rod 22 being brushed. The arcuate markings extend transversely to the longitudinal central axes of the stripes and form ring-shaped arrays which extend completely around the rod 22. When the rod 22 is subsequently lubricated before entering a drawing die, the markings readily retain the lubricant.

Uniform scale removal from the cylindrical outer side of the rod 22 by the brushes 32–46 is promoted by having the bristles 236 of the brushes deflected by the outer side of the rod and by allowing the natural resilience of the bristles to cause them to wipe across the circumferential width of a longitudinally extending linear segment of the rod 22. The deflection of the bristles 236 has been depicted schematically in the simplified illustration of FIG. 7. The deflection of the bristles 236 of the wire brushes 32–46 and the resulting wiping action promotes cleaning of the outer side of the rod.

The linear segment or stripe across which the bristles 236 of each of the brushes 32–46 wipes has a transverse arcuate extent of 45° or slightly more than about 45° along the periphery of the outer side of the rod. The longitudinally extending segment or stripe wiped by any one of the brushes 32–46 overlaps stripes wiped by other brushes.

Each of the front brushes 32, 34, 40 and 42 is disposed in a coaxial relationship with one of the rear brushes 36, 38, 44 or 46. Each front brush 32, 34, 40 and 42 rotates in the opposite direction from the direction of rotation of the rear brush 36, 38, 44 or 46 which is coaxial with the front brush. Since the coaxial front and rear brushes rotate in opposite directions, the coaxial front and rear brushes each wipe across the periphery of the rod 22 in longitudinally and circumferentially extending stripes which extend circumferentially about 45° and have a narrow longitudinally extending area where the stripes wiped by the coaxial front and rear brushes may overlap. The combined circumferential extent of the stripes or segments wiped by a pair of coaxial front and rear brushes is about or slightly greater than 90° about the periphery of the rod 22.

For example, the front brush 42 is coaxial with the rear brush 46 (FIGS. 3 and 5). The longitudinally extending stripe or segment wiped by the front brush 42 extends circumferentially about or slightly more than 45°. Also, the longitudinally extending stripe or segment wiped by the rear brush 46 extends circumferentially about or slightly more than 45°. Since the front and rear brushes 42 and 46 rotate in opposite directions, the longitudinal central axes of the stripes or segments wiped by the front and rear brushes 42 and 46 are offset by approximately 450 about the periphery of the rod 22. The combined longitudinally extending stripes or segments wiped by the coaxial brushes 42 and 46 extend through an arcuate distance of about or slightly more than 90° about the periphery of the rod 22.

As the rod 22 is pulled axially through the brushing machine 24, the rod is repetitively brushed by the wire brushes 32–46. Thus, as an axially extending incremental or short cylindrical length of the rod 22 moves into the brushing machine 24, upper and lower sides of a leading end of the axial segment of the rod are engaged by the left upper front wire brush 32 and the right lower front wire brush 40.

The wire brush 32 rotates in a counterclockwise direction while the wire brush 40 rotates in a clockwise direction. Therefore, the bristles 236 of the wire brushes 32 and 40 apply offsetting forces. As the bristles 236 of the wire brushes 32 and 40 wipe across spaced apart surface areas on the rod 22, scale and other foreign materials are removed from the rod and markings are formed on the surface of the rod. The wire brushes 32 and 40 wipe areas which extend 90° or slightly more than about 90° around the surface of the rod 22.

As the axially extending increment or short length of the rod 22 continues to move into the brushing machine 24, upper and lower sides of the leading end of the axial segment of the rod are engaged by the left lower front wire brush 34 and right upper front wire brush 42. Since the wire brushes 34 and 42 engage spaced apart surface areas on the rod 22, the radial forces applied against the rod by the wire brushes 34 and 42 are at least partially offsetting.

The wire brush 34 rotates in a clockwise direction while the wire brush 42 rotates in a counterclockwise direction. Therefore, the bristles 236 of the wire brushes 34 and 42 provide offsetting forces. As the bristles 236 of the wire brushes 34 and 42 wipe across spaced apart surface areas on the rod 22, scale and other foreign materials are removed from the rod and markings are formed in the surface of the rod.

The wire brushes 34 and 42 wipe 90° or slightly more than about 90° of the surface of the rod 22. Therefore, the left and right, upper and lower front wire brushes 32, 34, 40 and 42 are effective to brush 180° or slightly more than 180° of the surface area of the segment of the rod 22 as the segment passes through the front half of the brushing machine 24.

During continued movement of the axially extending incremental or short cylindrical length of the rod 22 through the brushing machine 24, the short axially extending length of the rod moves into engagement with the left upper rear wire brush 36 and the right lower rear wire brush 44 (FIGS. 4 and 5). Since the wire brushes 36 and 44 engage spaced apart surface areas on the rod 22, the radial forces applied against the rod by the wire brushes 36 and 44 are at least partially offsetting. The wire brush 36 rotates in a counterclockwise direction (as viewed in FIG. 4), that is from the rear of the brushing machine 24, and the wire brush 44 rotates in a clockwise direction, as viewed in FIG. 4). Therefore, the bristles 236 of the wire brushes 36 and 44 provide offsetting forces.

As the rod 22 continues to move still further through the brushing machine 24, upper and lower sides of the leading end of the axial segment of the rod 22 are engaged by the lower left rear wire brush 38 and the upper right rear wire brush 46. Since the wire brushes 38 and 46 engage spaced apart surface areas on the rod 22, the radial forces applied against the rod by the wire brushes 38 and 46 are at least partially offsetting. The wire brush 38 rotates in a clockwise direction, as viewed in FIG. 4, and the wire brush 46 rotates in a counterclockwise direction. Therefore, the bristles 236 of the wire brushes 38 and 46 provide offsetting forces.

The upper left rear wire brush 36 and lower right rear wire brush 44 are effective to wipe 90° or slightly more than about 90° of the surface of the rod 22. In addition, the lower right rear wire brush 38 and upper rear wire brush 46 are effective to wipe 90° or slightly more than about 90° of the surface of the rod 22. Therefore, the wire brushes 36, 38, 44 and 46 are effective to brush 180° or slightly more than about 180° around the surface of the rod 22 with a brushing action.

Each of the eight wire brushes 32–46 is effective to wipe about 45°0 or slightly more than about 45° about the periphery of the rod 22. Each of the four coaxial pairs of wire brushes 32–46 is effective to wipe 90° or slightly more than 90° about the periphery of the rod 22. This is because the wire brushes in each coaxial pair of wire brushes, rotate in opposite directions. The four coaxial pairs of wire brushes 32–46 are evenly spaced about the periphery of the rod 22. Therefore, the wire brushes 32–46 are effective to completely wipe the periphery of the rod 22 as the rod moves through the brushing machine 24.

In the illustrated embodiment of the invention, there are eight wire brushes 32–46 (FIG. 5). It is contemplated that a greater or lesser number of wire brushes could be utilized if desired. For example, ten wire brushes could be utilized. However, it is believed that eight wire brushes may be preferred.

In the illustrated embodiment of the invention, each of the front wire brushes 32, 34, 40 and 42 (FIG. 5) is axially aligned with one of the rear wire brushes 36, 38, 44 and 46. However, it is contemplated that the axes about which the front wire brushes 32, 34, 40 and 42 rotate could be offset from the axes about which the rear wire brushes 36, 38, 44 and 46 rotate. This is particularly true if the wire brushes are not disposed in coaxial pairs which rotate in opposite directions. Although the illustrated embodiment of the invention utilizes a pair of brush drive motors 70 and 72 (FIG. 2) to rotate the wire brushes 32–46, it is contemplated that either a greater or lesser number of motors could be utilized if desired. For example, each of the wire brushes could be driven by its own separate motor.

Controls

The controls 26 (FIG. 1) for the apparatus 20 enable the apparatus to automatically perform functions. The controls 26 include a break detection switch assembly 360 (FIG. 8) which is mounted on the front guard 90 (FIG. 1) of the housing structure 82. The break detection switch assembly 360 (FIG. 8) includes an arm 362 having a roller 364 which engages the outer side of the rod 22.

Figure 8:
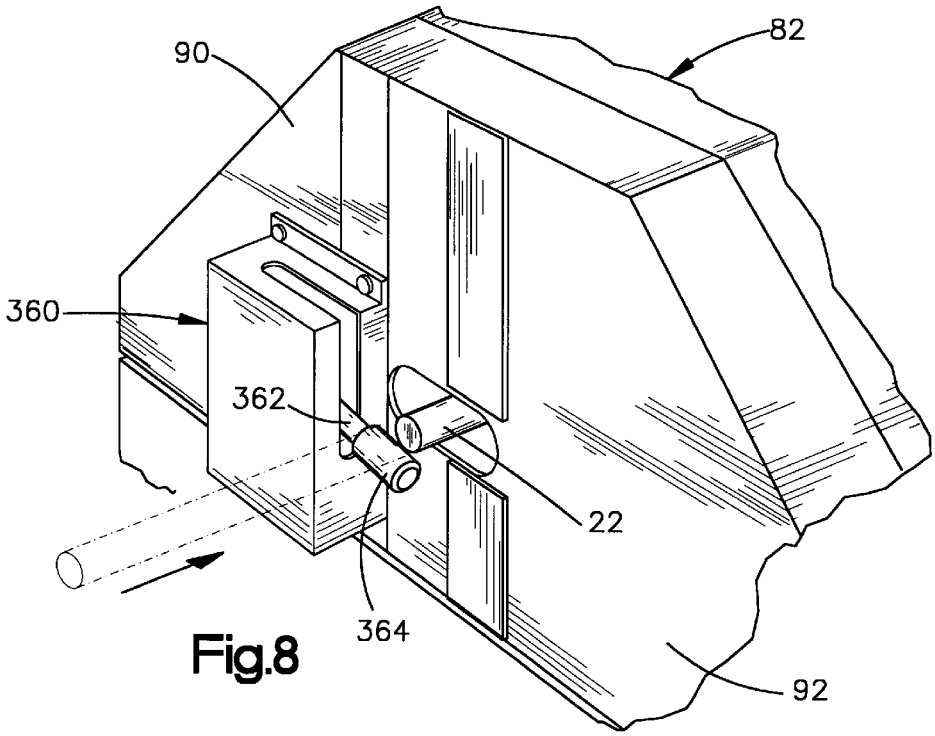
FIG. 8 is an illustration of a break detector switch assembly which is mounted on the apparatus of FIG. 1.

If for some unforeseen reason a break should occur in the rod 22, the gravity biased arm 362 would be pivoted downward, to the position shown in FIG. 8. Downward movement of the arm 362 results in the break detection switch assembly 360 providing an output signal to the controls 26 (FIG. 1) indicating the occurrence of a break in the rod 22. Upon receiving a signal from the break detection switch assembly 360, the controls 26 automatically interrupt brushing of the rod 22.

In accordance with a feature of the invention, the controls 26 (FIG. 1) automatically compensate for wear of the wire brushes 32–46. During brushing of the rod 22, the bristles 236 on the wire brushes 32–46 wear and the diameter of the wire brushes is reduced. To maintain a uniform brushing action throughout the length of the rod 22, the controls 26 are effective to detect the occurrence of wear of the wire brushes 32–46 and to effect operation of the carriage drive assembly 66 to simultaneously move the wire brushes toward the rod 22.

In the illustrated embodiment of the invention, wear of the wire brushes 32–46 is detected as a function of a change in the load applied to the brush drive motors 70 and 72 by the front and rear brush drive belts 256, 288, 272 and 304 (FIGS. 2 and 4). As the wire brushes 32–46 become worn, the effective diameter of the wire brushes decreases and the force or torque which must be transmitted from the brush drive motors 70 and 72 to rotate the wire brushes decreases. The reduction in the force which must be transmitted from the motors 70 and 72 to rotate the wire brushes 32–46 results in a reduction of the electrical current required to operate the motors.

In the illustrated embodiment of the invention, the controls 26 include a brush load controller 372 which has been indicated schematically in FIG. 1. The brush load controller 372 detects variations in the current required to energize the brush drive motors 70 and 72. Upon the occurrence of brush wear, the torque load transmitted to the brush drive motors 70 and 72 is reduced with a resulting reduction in the current required to energize the motors.

The brush load controller 372 detects the reduction in the current required to energize the brush drive motors 70 and 72. In response to the brush load controller 372 detecting a reduction in the current required to energize the brush drive motors 70 and 72, the controls 26 effect operation of the carriage drive assembly 66 (FIG. 6) to simultaneously move the left and right carriages 54 and 60 toward each other. As this occurs, the wire brushes 32–46 are pressed against the rod 22 and the electrical current required to energize the brush drive motors 70 and 72 increases.

When the electrical current required to energize the brush drive motors 70 and 72 increases to a predetermined current corresponding to a desired brushing force, the brush load controller 372 provides an output signal to the controls 26 and the operation of the carriage drive assembly 66 is interrupted. Therefore, during brushing of the rod 22, the controls 26 automatically effect operation of the carriage drive assembly 66 to press the wire brushes 32–46 against the rod 22 with a substantially constant force to compensate for wear of the wire brushes. The compensation for wear of the wire brushes 32–46 is accomplished automatically without the intervention of an operator of the brushing machine 24.

It is contemplated that during extended use of the brushing machine 24, the wire brushes 32–46 will become worn to such an extent that replacement will become necessary. For example, the identical wire brushes 32–46 may initially have an outside diameter of approximately 12 inches. After the wire brushes 32–46 have been worn away to an outside diameter of approximately 9 inches, it is believed that it will be desired to replace the brushes.

In accordance with another feature of the invention, when a maximum permissible wear of the wire brushes 32–46 has occurred, the controls 26 automatically interrupt a brushing operation and move the wire brushes to their retracted positions. In order to detect when the maximum permissible brush wear has occurred, the brush load controller 372 also includes a limit switch 380 (FIG. 6) which is connected with the controls 26. When the carriages 54 and 56 have been moved toward each other through a distance corresponding to the maximum permissible amount of brush wear, a projection 382 on the left carriage 54 (FIG. 6) will actuate the limit switch 380. Actuation of the limit switch 380 provides an output signal to the controls 26.

In response to the output signal from the limit switch 380, the controls 26 effect operation of the carriage drive assembly 66 to simultaneously move the left and right carriages 54 and 60 to fully retracted positions. When the carriages 54 and 60 reach fully retracted positions, a limit switch 386 is actuated by a projection 388 extending from the left carriage 54 (FIG. 6). When the projection 388 actuates the limit switch 386, the limit switch provides an output signal which causes the controls 26 to interrupt operation of the carriage drive assembly 66 with the wire brushes 32–46 in their fully retracted positions.

During setting up of the brushing machine 24 to brush a wire rod 22, the left group 52 of wire brushes (FIG. 5) is pressed against the rod 22 by the left carriage 54 (FIG. 2). Simultaneously therewith, the right group 58 of wire brushes (FIG. 5) is pressed against the rod 22 by the right carriage 60 (FIG. 2). At this time, the wire brushes 32–46 are-being rotated by the wire brush drive motors 70 and 72.

If the left group 52 of wire brushes is pressed against the rod 22 with the same force as the right group 58 of wire brushes, equal electrical currents will be required to energize the brush drive motors 70 and 72. However, if one group 52 or 58 of wire brushes is being pressed against the rod with a greater force than the other group of wire brushes, the electrical current required to energize one of the brush drive motors 70 or 72 will be greater than the electrical current required to drive the other brush motor.

In order to obtain a uniform brushing action, both left group 52 of wire brushes and the right group 58 of wire brushes should be pressed against the rod 22 with the same force. Therefore, the same electrical current should be required to energize the left brush drive motor 70 as is required to drive the right brush drive motor 72.

During setting up of the brushing machine 24, the electrical current required to drive the left and right brush drive motors 70 and 72 is checked by the controls 26 to determine whether or not equal electrical currents are required to energize the brush drive motors 70 and 72. If unequal currents are required to drive the brush drive motors 70 and 72, either the left adjustment mechanism 76 (FIG. 6) or the right adjustment mechanism 78 is manually actuated to move one of the carriages 54 or 60 relative to the other carriage. The relative movement between the carriages 54 and 60 changes the force with which the group of wire brushes mounted on the carriage are pressed against the rod 22. When the groups 52 and 58 of wire brushes are pressed against the rod 22 with equal force, the electrical current required to energize the brush drive motors 70 and 72 will be equal.

To enable the electrical current required to energize the brush drive motors 70 and 72 to be checked during setting up of the brushing machine 24, a current measuring meter 392 (FIG. 1) is provided in the controls 26. Upon actuation of a switch 394, the meter 392 indicates the current required to energize the left brush drive motor 70. Upon actuation of a switch 396, the meter 392 indicates the current required to energize the right brush drive motor 72. The adjustment mechanisms 76 and 78 (FIG. 6) are manually actuated to change the positions of the carriages 54 and 60 so that the current required to energize the left and right brush drive motors 70 and 72 is the same.

The left adjustment mechanism 76 includes an internally threaded nut 400 which is disposed in engagement with the lefthand screw 172. Rotation of the nut 400 moves the left carriage 54 relative to the lefthand screw 172 and the right carriage 60.

The right adjustment mechanism 78 has the same general construction as the left adjustment mechanism 76. However, the right adjustment mechanism 78 includes a nut 404 having a righthand internal thread which engages the righthand screw 174. The nut 404 in the right adjustment mechanism 78 can be manually actuated to move the right carriage 60 relative to the left carriage 54.

If separate carriage drive motors are provided for the left and right carriages 54 and 60 instead of the single drive motor 184 (FIG. 6), the left and right adjustment mechanisms 76 and 78 could be eliminated. Thus, during setting up of a brushing machine 24 having a pair of carriage drive motors rather than the single drive motor 184, the carriage drive motors would be operated to move the carriages 54 and 60 toward the rod 22. Operation of either one of the two separate carriage drive motors would be interrupted when the wire brushes mounted on the associated carriage loaded the associated brush drive motor to an extent corresponding to a predetermined brush drive motor energizing current.

In addition to the foregoing apparatus, the controls 26 include a manually actuatable power on switch button 410 (FIG. 1) and a manually actuatable power off switch button 412. A motor start switch actuator button 414 is manually actuatable to effect energization of the left and right brush drive motors 70 and 72. A motor stop switch actuator button 416 is manually actuatable to interrupt operation of the left and right brush drive motors 70 and 72.

During setting up of the brushing machine 24, a manually actuatable carriage motor start switch button 418 is operable to effect operation of the carriage drive motor 184 to move the carriages 54 and 60 toward each other. A manually actuatable carriage drive motor stop switch button 420 can be operated to interrupt operation of the carriage drive motor 184 and inward movement of the carriages 54 and 60. Similarly, a manually actuatable carriage motor start button 422 is operable to effect operation of the carriage drive motor 184 to move the carriages 54 and 60 away from each other. A carriage motor stop switch actuator button 424 is manually actuatable to interrupt operation of the carriage drive motor 184 and movement of the carriages 54 and 60 away from each other.

In addition, the controls 26 include a controller reset switch 428. A fast forward switch 430 is manually actuatable to activate the carriage drive motor 184 to rapidly move the carriages 54 and 60 toward each other. A set point light 454 is lit when the carriages 54 and 60 and wire brushes 32–46 are at set points. The controls 26 include an emergency stop switch 455 which is manually actuatable to stop operation of the brushing machine 24.

The controls 26 include a three-position switch 456 for brush pressure. The switch 456 can be set to low, medium or high settings, as may be desired. For example, the brush pressure switch settings can be adjusted so that 40% of the load of the brush drive motors 70 and 72 is the low setting, 50% of full load of the brush drive motors is the medium setting, and 60% of the full load of the brush drive motors is the high setting. The loads applied to the brush drive motors 70 and 72 are indicated by the magnitude of the electrical current required to operate the brush drive motors 70 and 72. The full load for the brush drive motors 70 and 72 may be defined as a maximum permissible combined electrical current conducted to the brush drive motors. The magnitude of the current required to operate the brush drive motors 70 and 72 is detected by the brush load controller 372 (FIGS. 1 and 9).

The controls 26 of FIG. 1 are hard wired circuitry and include relays which are used to control the operation of the brushing machine 24. However, it is believed that it may be preferred to utilize computerized solid state logic controls rather than the hard wired controls 26. Computerized controls 500 (FIG. 9) may be used to control the operation of the wire brushing machine 24 rather than the controls 26.

The computerized controls 500 include an input/output controller 502. The controller 502 receives input signals from the break detector switch assembly 360 (FIG. 8). Thus, if the rod 22 should break, the break detector 360 provides an input to the controller 502 indicating the occurrence of a break in the rod. A fully extended limit switch 380 (FIGS. 6 and 9) provides an input to the controller 502 when the left carriage 54 is in a fully extended position in which the wire brushes 32–46 have been worn to the maximum permissible extent. The fully retracted limit switch 386 (FIG. 6) provides an input to the controller 502 (FIG. 9) when the carriages 54 and 60 are in a fully retracted position.

Figure 9:
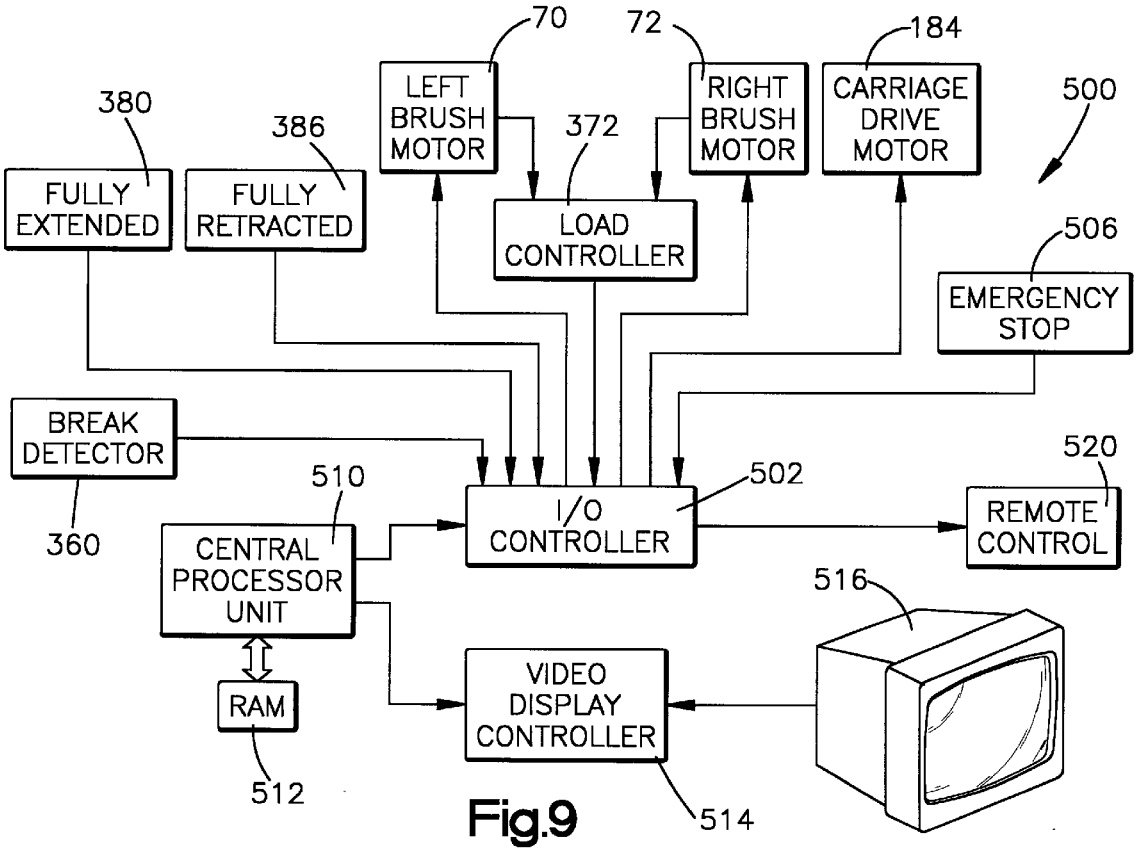
FIG. 9 is a simplified schematic illustration of controls used with the apparatus of FIG. 1.

The brush load controller 372 (FIG. 1) is connected with the brush drive motors 70 and 72 and the controller 502 (FIG. 9). The brush load controller 372 senses the magnitude of the current required to energize the left and right brush drive motors 70 and 72. When the current required to drive the left and right brush drive motors 70 and 72 has decreased by a predetermined magnitude, logic circuitry in the controller 502 determines that the wire brushes 32–46 have worn. The carriage drive assembly 66 (FIG. 6) is then energized to move the left and right carriages 54 and 60 toward the rod 22. This moves the left and right groups 52 and 58 of wire brushes toward the rod 22 to compensate for the wear.

The controller 502 (FIG. 9) energizes the left and right brush drive motors 70 and 72 when the brushing machine 24 is to be utilized to brush a rod 22. In addition, the controller 502 energizes the carriage drive motor 184 (FIG. 6) to position the left and right carriages relative to the rod during brushing of the rod.

An emergency stop 506 is connected with the controller 502. In the event of an emergency, an operator of the brushing machine 24 can manually actuate the emergency stop switch to interrupt a brushing operation.

A central processor unit 510 (FIG. 9) directs operation of the controller 502. The central processor unit 510 receives instructions from a memory bank 512. Information from the central processor unit 510 also goes to a video display controller 514 and then to a monitor 516. A keyboard (not shown) can be employed to direct operation of the central processor unit 510 via the controller 502. In addition, a remote control unit 520 may be connected with the controller 502 to enable the brushing machine to be controlled by an operator at a location spaced from the brushing machine.

Operation

Figure 10:
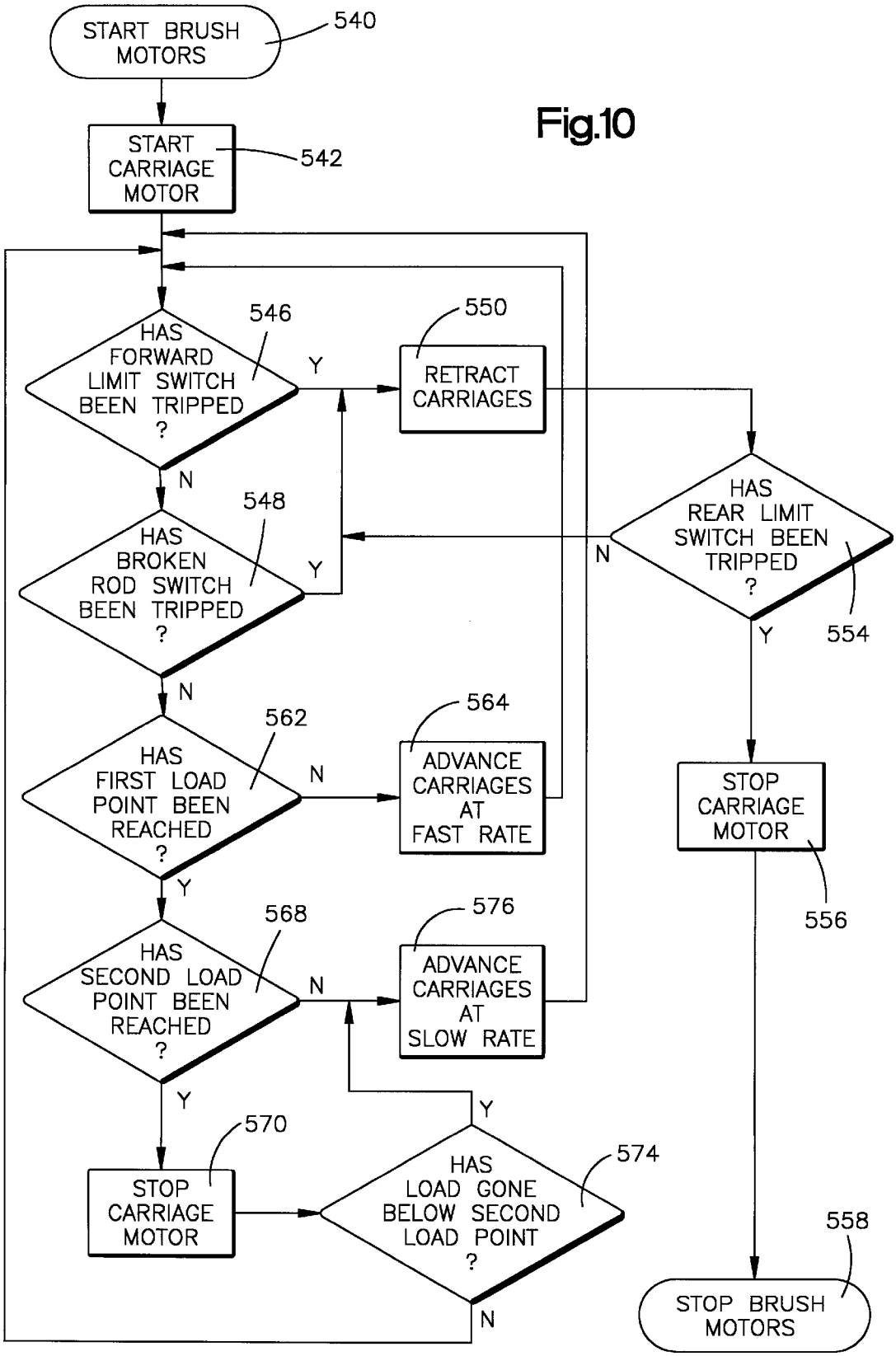
FIG. 10 is a flow chart of the operation of the apparatus of FIG. 1.

The sequence of operation of the brushing machine 24 is schematically illustrated in FIG. 10. When a brushing operation is to be undertaken, the leading end portion of the rod 22 is moved through the front guide 96 (FIGS. 1 and 2) and the rear guide 98 (FIG. 4). At this time, a leading portion of the rod 22 is disposed in the brushing machine 24 between the retracted left and right groups 52 and 58 (FIG. 5) of wire brushes. The left and right carriages 54 and 60 are in their fully retracted positions so that the limit switch 386 (FIG. 6) is actuated by the projection 388 on the left carriage 54.

The left and right brush drive motors 70 and 72 are then energized, in the manner indicated by the step 540 in FIG. 10. The carriage drive motor 184 is then energized, in the manner indicated by the step 542 in FIG. 10. Operation of the carriage drive motor 184 moves the left and right carriages 54 and 60 toward each other. As this occurs, the projection 388 (FIG. 6) moves away from the limit switch 386 and an indication is provided to the controller 502 (FIG. 9) that the wire brushes 32–46 are moving toward the rod 22.

Decision block 546 (FIG. 10) indicates that a check is made to determine whether or not the fully extended limit switch 380 (FIG. 6) has been tripped. Since the carriages 54 and 60 were in their fully retracted positions, the fully extended limit switch 380 will not have been tripped. The controller 502 then checks to see whether or not the break detector limit switch 360 has been actuated, in the manner indicated by the decision block 548 in FIG. 10.

In the unlikely event that the break detector switch 360 has been tripped, the controller 502 initiates operation of the carriage drive motor 184 to retract the carriages 54 and 60. This is indicated by step 550 in FIG. 10. When the fully retracted limit switch 386 is actuated by the projection 388, as indicated by the decision block 554 in FIG. 10, operation of the carriage drive motor 184 is stopped, as indicated by the step 556 in FIG. 10. The left and right brush drive motors 70 and 72 are then stopped, as indicated by the step 558. The rod 22 can then be replaced or repositioned as required as a result of the break in the rod.

If the break detector switch 360 has not been actuated, which will probably be the situation, the controller 502 (FIG. 9) checks to determine whether or not the carriages have reached a first load point, as indicated by the decision block 562 (FIG. 10). When the carriages 54 and 60 are at the first load point, the rotating wire brushes 32–46 are in contact with the rod 22. At this time, the output from the brush load controller 372 indicates that the current required to energize the brush motors, 70 and 72 has increased to a predetermined current corresponding to initial engagement of the wire brushes 32–46 with the rod 22.

When the carriages 54 and 60 reach the first load point, the controller 502 (FIG. 9) reduces the speed of operation of the carriage drive motor 184 to slowly advance the rotating wire brushes 32–46 toward the moving workpiece 22. As the carriages 54 and 60 are slowly advanced toward the rod 22, the rotating brushes 32–46 are moved into further engagement with the rod. When the rotating brushes apply a predetermined force against the rod 22, the brush load controller 372 provides an output signal to the controller 502 indicating that the desired pressure is present between the wire brushes 32–46 and the rod 22, as indicated by the decision block 568 in FIG. 10. When this occurs, the carriage drive motor 184 is stopped, as indicated by the step 570.

The brush load controller 372 detects when the rotating wire brushes 32–46 are engaging the rod 22 with the desired pressure by monitoring the electrical current utilized to energize the left and right brush drive motors 70 and 72. The electrical current required to energize the brush drive motors 70 and 72 increases as the pressure applied against rod 22 by the rotating wire brushes 32–46 increases and the torque load on the brush drive motors increases. When the electrical current for energizing the brush drive motors 70 and 72 has reached a predetermined magnitude, corresponding to a desired pressure of the rotating wire brushes 32–46 against the rod 22, the controller 502 interrupts operation of the carriage drive motor 184 as indicated by the step 570 in FIG. 10.

As the rod 22 is pulled in the direction indicated by the arrows 28 in FIG. 5, scale and other surface imperfections are brushed from the rod. As the rod 22 is pulled through the brushing machine 24, the entire peripheral surface of the rod is brushed.

In accordance with one of the features of the present invention, there is automatic compensation for wear of the wire brushes 32–46 during a brushing operation. Thus, throughout the brushing operation, the controller 502 (FIG. 9) is continuously checking to determine whether or not the brush load controller 372 is indicating that the electrical current required for energizing the left and right brush drive motors 70 and 72 has decreased to a level indicating that the load applied by the brushes 32–46 to the rod 22 has been reduced due to wear of the brushes. If the brush load controller 372 indicates that brush wear has occurred, as indicated schematically by decision block 574 in FIG. 10, the controller 502 energizes the carriage drive motor 184 to slowly advance the rotating wire brushes 32–46 toward the rod 22 at a slow rate, as indicated by step 576 in FIG. 10. The slow rate of advance of the wire brushes 32–46 toward the rod 22 is continued until the brush load controller 372 detects that the current for energizing the brush drive motors 70 and 72 has reached a desired magnitude. When this occurs, the carriage drive motor 570 is stopped.

Although the foregoing explanation of the operation of the brushing machine 24 has been in conjunction with the computerized controls 500 of FIG. 9, it should be understood that the operation would be the same with the hard wired controls 26 of FIG. 1. Thus, either the controls 26 or the controls 500 may be utilized to control the operation of the brushing machine 24.

Conclusion

In view of the foregoing description, it is apparent that the present invention provides a new and improved apparatus 20 which includes a plurality of brushes which are rotated to brush a workpiece or rod 22. A detector, that is, the brush load controller 372, is provided to detect brush wear during brushing of the workpiece 22. To automatically compensate for brush wear, an adjustment assembly, that is the carriage drive assembly 66, changes the positions of the brushes 32–46 relative to the workpiece 22 in response to the detector 372 detecting brush wear. When a predetermined maximum permissible extent of brush wear has occurred, the brushes 32–46 are automatically moved away from the workpiece 22 by the controls 26 and carriage drive assembly 66 to interrupt the brushing operation.

The brushes 32–46 are rotatable about axes which extend parallel to the longitudinal central axis of the workpiece 22. The brush adjustment assembly, that is, the carriage drive assembly 66, moves each of the brushes 32–46 relative to the workpiece in a direction perpendicular to the axis about which the brush rotates. During setting up of the apparatus 20 to brush a workpiece, the brush adjustment assemblies 76 and 78 may be operated to change the positions of the brushes 32–46 to equalize torque loads which are applied to motors which drive the brushes.

Also, from the above, it should be apparent that the apparatus of the present invention is self-adjusting, compact, provides essentially circumferential markings on the workpiece and is easy to set-up and maintain.

Having described the invention, the following is claimed:

1. An apparatus for use in brushing the periphery of an elongate workpiece as the workpiece moves through said apparatus, said apparatus comprising:

a plurality of brushes which are rotatable about a plurality of axes extending parallel to a longitudinal central axis of the workpiece;

drive means for rotating each brush of said plurality of brushes about one of the axes of the plurality of axes to brush the periphery of the workpiece; and brush adjustment means for moving each brush of said plurality of brushes relative to the workpiece in a direction perpendicular to the axis about which the brush rotates to adjust the position of the brush relative to the workpiece.

2. An apparatus as set forth in claim 1 further including detector means for detecting brush wear during brushing of the workpiece, said brush adjustment means being operable to change the positions of at least some of said brushes of said plurality of brushes relative to the workpiece in response to said detector means detecting brush wear during brushing of the workpiece.

3. An apparatus as set forth in claim 1 wherein said plurality of brushes are disposed in an array which extends around the workpiece with the axes about which at least some of said brushes are rotatable being vertically offset from the longitudinal central axis of the workpiece.

4. An apparatus as set forth in claim 1 wherein said plurality of brushes includes at least four brushes.

5. An apparatus as set forth in claim 1 wherein said plurality of brushes includes a plurality of pairs of brushes, each brush of a pair of brushes being rotatable about a common axis which extends parallel to the longitudinal central axis of the workpiece and extends through a central portion of each brush of the pair of brushes.

6. An apparatus as set forth in claim 5 wherein a first brush of each pair of brushes rotates in a first direction and a second brush of each pair of brushes rotates in a second direction about the common axis which extends through the central portion of each brush of the pair of brushes.

7. An apparatus as set forth in claim 1 wherein a first brush of said plurality of brushes engages an upper portion of the periphery of the workpiece and a second brush of said plurality of brushes engages a lower portion of the periphery of the workpiece throughout brushing of the workpiece.

8. An apparatus as set forth in claim 7 wherein said first brush is rotated in a first direction and said second brush is rotated in a second direction opposite to the first direction by said drive means throughout brushing of the workpiece.

9. An apparatus as set forth in claim 8 wherein said first brush is rotatable about a first axis which is disposed at a level above the longitudinal central axis of the workpiece throughout brushing of the workpiece and said second brush is rotatable about an axis which is disposed at a level below the longitudinal central axis of the workpiece throughout brushing of the workpiece, said first and second axes being disposed in a plane which contains the longitudinal central axis of the workpiece.

10. An apparatus as set forth in claim 1 further including first and second carriages which are movable toward and away from the axis of rotation of the workpiece by said brush adjustment means, said plurality of brushes includes a first group of brushes which are rotatably mounted on said first carriage and a second group of brushes which are rotatably mounted on said second carriage, said brush adjustment means being operable to move said first and second carriages toward and away from the workpiece.

11. An apparatus as set forth in claim 10 wherein said drive means includes a first motor mounted on said first carriage and connected with said first group of brushes and a second motor mounted on said second carriage and connected with said second group of brushes, said first motor being movable with said first carriage and first group of brushes during operation of said brush adjustment means, said second motor being movable with said second carriage and said second group of brushes during operation of said brush adjustment means.

12. An apparatus as set forth in claim 10 wherein said brush adjustment means includes a lefthand drive thread connected with said first carriage, a righthand drive thread connected with said second carriage, and a carriage drive motor which is connected with said left and righthand drive threads, said carriage drive motor being operable to rotate said left and righthand drive threads to move said first and second carriages relative to the workpiece.

13. An apparatus as set forth in claim 1 wherein said drive means includes at least one electric motor connected with at least one brush of said plurality of brushes, said one brush engages the workpiece with sufficient force to result in the application of a torque load on said electric motor during brushing of the workpiece, said brush adjustment means being operable to change the position of said brush relative to the workpiece to maintain a predetermined minimum torque load on said electric motor means during brushing of the workpiece.

14. An apparatus as set forth in claim 1 wherein each of said brushes is movable between a retracted position spaced from the workpiece and an extended position engaging the workpiece, said apparatus including means for detecting when there is a predetermined extent of brush wear, said brush adjustment means being operable to effect movement of said plurality of brushes from extended positions engaging the workpiece to retracted positions spaced from the workpiece in response to detection of the predetermined extent of brush wear.

15. An apparatus as set forth in claim 1 further including suction means for inducing a flow of fluid containing particles removed from the workpiece away form said brushes during brushing of the workpiece.

16. An apparatus as set forth in claim 1 wherein said plurality of brushes includes a first group of brushes and a second group of brushes, said brush adjustment means being operable to move said first group of brushes in a first direction toward the workpiece while the brushes of the first group of brushes rotate about axes extending parallel to the central axis of the workpiece and being operable to move said second group of brushes in a second direction toward the workpiece while the brushes of the second group of brushes rotate about axes extending parallel to the central axis of the workpiece.

17. An apparatus as set forth in claim 1 wherein said brushes are disposed in an array which extends around a portion of the longitudinally extending side of the workpiece and are positioned relative to each other so that the entire portion of the longitudinally extending side of the workpiece is engaged by at least one of said brushes upon movement of the workpiece through said apparatus.

18. An apparatus as set forth in claim 1 wherein said brushes are engageable with the entire surface on a portion of the workpiece during movement of the portion of the workpiece through said apparatus.

19. An apparatus for use in brushing a longitudinally extending side of a workpiece as the workpiece moves through said apparatus, said apparatus comprising:

a plurality of brushes which are movable between retracted positions spaced from the longitudinally extending side of the workpiece and extended positions engaging the longitudinally extending side of the workpiece;

motor means for rotating said plurality of brushes to brush the longitudinally extending side of the workpiece when said plurality of brushes are in their extended positions;

detector means for detecting when there is a predetermined extent of brush wear during brushing of the workpiece; and drive means for moving said plurality of brushes from their extended positions to their retracted positions in response to said detector means detecting the predetermined extent of brush wear during brushing of the workpiece.

20. An apparatus as set forth in claim 19 wherein said plurality of brushes are rotatable about a plurality of axes which extend parallel to a longitudinal central axis of the workpiece when said plurality of brushes are in their extended positions.

21. An apparatus as set forth in claim 19 wherein said detector means includes means for detecting brush wear which is less than the predetermined extent of brush wear during-brushing of the longitudinally extending side of the workpiece, said drive means being operable to change the positions of said brushes relative to the workpiece in response to said detector means detecting brush wear which is less than the predetermined extent of brush wear during brushing of the longitudinally extending side of the workpiece.

22. An apparatus as set forth in claim 19 wherein said plurality of brushes are rotatable about a plurality of axes which extend parallel to a longitudinal central axis of the workpiece, said drive means being operable to move each brush of said plurality of brushes between the retracted and extended positions along a path perpendicular to the axis about which the brush rotates.

23. An apparatus as set forth in claim 19 wherein said drive means is operable to move said motor means relative to the workpiece along with said plurality of brushes during movement of said plurality of brushes between the extended and retracted positions.

24. An apparatus for use in brushing the periphery of an elongate workpiece as the workpiece moves through said apparatus, said apparatus comprising:

a plurality of brushes which are engageable with the workpiece, each of said brushes of said plurality of brushes is rotatable about an axis extending parallel to a longitudinal central axis of said workpiece;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece, said brush adjustment means being operable to move at least some of the brushes of said plurality of brushes along a path extending perpendicular to the longitudinal central axis of the workpiece to change the position of at least some of the brushes of said plurality of brushes relative to the workpiece.

25. An apparatus as set forth in claim 24 wherein said motor means includes an electric motor, said detector means including current sensor means for detecting a reduction in electric current conducted to said electric motor upon occurrence of brush wear during brushing of the outer side of the workpiece, said brush adjustment means being operable to move at least one of the brushes of said plurality of brushes toward the workpiece in response to said current sensor means detecting a reduction in the electric current conducted to said electric motor.

26. An apparatus as set forth in claim 24 wherein said brushes are engageable with the entire surface area on a portion of the workpiece during movement of the portion of the workpiece through said apparatus.

27. An apparatus for use in brushing the periphery of an elongate workpiece as the workpiece moves through said apparatus, said apparatus comprising:

a plurality of brushes which are engageable with the workpiece;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece, said detector means includes means for detecting a predetermined amount of brush wear and for effecting movement of at least some of the brushes of said plurality of brushes from a first condition engaging the workpiece to a second condition spaced from the workpiece in response to detection of the predetermined amount of brush wear.

28. An apparatus for use in brushing the periphery of an elongate workpiece as the workpiece moves through said apparatus, said apparatus comprising:

a plurality of brushes which are engageable with the workpiece, said plurality of brushes includes first and second groups of brushes;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece, said brush adjustment means being operable to simultaneously move said first and second groups of brushes toward the workpiece in response to said detector means detecting brush wear.

29. An apparatus for use in brushing the periphery of an elongate workpiece as the workpiece moves through said apparatus, said apparatus comprising:

a plurality of brushes which are engageable with the workpiece;

motor means for rotating said plurality of brushes to brush the workpiece;

detector means for detecting brush wear during brushing of the workpiece;

brush adjustment means for changing positions of at least some of said brushes of said plurality of brushes relative to the workpiece in response to said detector means detecting brush wear during brushing of the workpiece; and first and second carriages movable toward and away from the workpiece, said plurality of brushes includes a first group of brushes each of which is rotatably mounted on said first carriage and a second group of brushes each of which is rotatably mounted on said second carriage, said brush adjustment means includes means for moving said first and second carriages toward the workpiece in response to said detector means detecting brush wear during brushing of the workpiece.

30. An apparatus as set forth in claim 29 wherein said motor means includes a first electric motor mounted on said first carriage and connected with said first group of brushes and a second electric motor mounted on said second carriage and connected with said second group of brushes, said first electric motor being movable with said first carriage and first group of brushes during operation of said brush adjustment means, said second electric motor being movable with said second carriage and said second group of brushes during operation of said brush adjustment means.

31. An apparatus as set forth in claim 30 wherein said brush adjustment means includes a lefthand drive thread connected with said first carriage, a righthand drive thread connected with said second carriage, and a carriage drive motor which is connected with said left and righthand drive threads, said carriage drive motor being operable to rotate said left and righthand drive threads to move said first and second carriages relative to the workpiece.

32. An apparatus for use in brushing the periphery of an elongate workpiece as the workpiece moves through said apparatus, said apparatus comprising:

a plurality of brushes which are engageable with the workpiece, each of said brushes of said plurality of brushes is engageable with a portion of a longitudinally extending side of the workpiece, said plurality of brushes being disposed in an array which extends around the workpiece and the portions of the longitudinally extending side of the workpiece engaged by said plurality of brushes are offset around the workpiece and have a combined extent which is at least as great as the extent of the side of the workpiece as viewed in a plane extending perpendicular to a central axis of the workpiece;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece.

33. An apparatus for use in brushing the periphery of an elongate workpiece as the workpiece moves through said apparatus, said apparatus; comprising:

a plurality of brushes which are engageable with the workpiece, said plurality of brushes includes a first group of brushes and a second group of brushes;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece, said brush adjustment means being operable to simultaneously move said first and second groups of brushes toward the workpiece in response to said detector means detecting brush wear.

34. An apparatus as set forth in claim 33 wherein said brushes are disposed in an array which extends around a portion of the longitudinally extending side of the workpiece and are positioned relative to each other so that the entire portion of the longitudinally extending side of the workpiece is engaged by at least one of said brushes upon movement of the portion of the workpiece through said apparatus.

35. An apparatus for use in brushing the periphery of an elongate workpiece as the workpiece moves through said apparatus, said apparatus comprising:

a plurality of brushes which are engageable with the workpiece, said plurality of brushes are rotatable about axes which extend parallel to a longitudinal central axis of the workpiece;

motor means for rotating said plurality of brushes to brush the workpiece;

detector means for detecting brush wear during brushing of the workpiece; and brush adjustment means for changing positions of at least some of said brushes of said plurality of brushes relative to the workpiece in response to said detector means detecting brush wear during brushing of the workpiece, said brush adjustment means being operable to move each of said brushes of said plurality of brushes toward the longitudinally extending side of the workpiece in response to said detector means detecting brush wear while the axes about which said brushes are rotatable are maintained parallel to the longitudinal central axis of the workpiece.

36. An apparatus as set forth in claim 35 further including suction means for inducing a flow of fluid containing particles removed from the workpiece away form said brushes during brushing of the workpiece.

37. An apparatus for use in brushing the periphery of an elongate workpiece as the workpiece moves through said apparatus, said apparatus comprising:

a plurality of brushes which are engageable with the workpiece, each of said brushes is movable between a retracted position spaced from the workpiece and an extended position engaging the workpiece;

motor means for rotating said plurality of brushes to brush the workpiece;

detector means for detecting brush wear during brushing of the workpiece, said detector means including means for detecting when there is a predetermined extent of brush wear; and brush adjustment means for changing positions of at least some of said brushes of said plurality of brushes relative to the workpiece in response to said detector means detecting brush wear during brushing of the workpiece, said brush adjustment means being operable to effect movement of said brushes from extended positions engaging the workpiece to retracted positions spaced from the workpiece in response to detection of the predetermined extent of brush wear.

38. An apparatus as set forth in claim 37 wherein said plurality of brushes engage the workpiece with sufficient force to result in the application of a torque load on said motor means during brushing of the workpiece, said detector means being effective to detect a reduction in the torque load applied to said motor means as a result of brush wear during brushing of the workpiece, said brush adjustment means being operable to change the positions of said brushes relative to the workpiece to maintain a predetermined minimum torque load on said motor means during brushing of the workpiece.

39. An apparatus for use in brushing the periphery of an elongate workpiece as the workpiece moves through said apparatus, said apparatus comprising:

first and second groups of brushes which are engageable with the periphery of the workpiece;

first motor means for rotating brushes in the first group of brushes to brush a first portion of the periphery of the workpiece, said first motor means includes a first electric motor;

second motor means for rotating brushes in the second group of brushes to brush a second portion of the periphery of the workpiece, said second motor means includes a second electric motor; and detector means for detecting when said first group of brushes is effective to cause the application of a first torque load to said first motor means, said detector means being effective to detect when said second group of brushes is effective to cause the application of a second torque load to said second motor means, said detector means includes means for sensing the magnitude of an electrical current conducted to said first electric motor during brushing of the workpiece with the first group of brushes and for sensing the magnitude of an electrical current conducted to said second electric motor during brushing of the workpiece with the second group of brushes.

40. An apparatus as set forth in claim 39 further including brush adjustment means for changing the positions of brushes in at least one of said first and second groups of brushes to equalize the torque loads which are applied to said first and second motor means.

41. An apparatus for use in brushing the periphery of an elongate workpiece as the workpiece moves through said apparatus, said apparatus comprising:

first and second groups of brushes which are engageable with the periphery of the workpiece;

first motor means for rotating brushes in the first group of brushes to brush a first portion of the periphery of the workpiece;

second motor means for rotating brushes in the second group of brushes to brush a second portion of the periphery of the workpiece;

detector means for detecting when said first group of brushes is effective to cause the application of a first torque load to said first motor means, said detector means being effective to detect when said second group of brushes is effective to cause the application of a second torque load to said second motor means;

a first carriage which is movable toward and away from the workpiece, said first group of brushes being disposed on said first carriage;

a second carriage which is movable toward and away from the workpiece, said second group of brushes being disposed on said second carriage; and brush adjustment means which is operable to move said first carriage relative to said second carriage and the workpiece to vary the torque load applied to said first motor means relative to the torque load applied to said second motor means.

42. An apparatus for use in brushing the periphery of an elongate workpiece as the workpiece moves through said apparatus, said apparatus comprising:

first and second groups of brushes which are engageable with the periphery of the workpiece, said brushes of said first group of brushes are rotatable about a first plurality of axes extending parallel to the longitudinal central axis of the workpiece, said brushes of said second group of brushes being rotatable about a second plurality of axes extending parallel to the longitudinal central axis of the workpiece;

first motor means for rotating brushes in the first group of brushes to brush a first portion of the periphery of the workpiece;

second motor means for rotating brushes in the second group of brushes to brush a second portion of the periphery of the workpiece;

detector means for detecting when said first group of brushes is effective to cause the application of a first torque load to said first motor means, said detector means being effective to detect when said second group of brushes is effective to cause the application of a second torque load to said second motor means; and brush adjustment means which is operable to move said first group of brushes toward and away from the workpiece along a path extending perpendicular to the longitudinal central axis of the workpiece and to move said second group of brushes toward and away from the workpiece along a path extending perpendicular to the longitudinal central axis of the workpiece.

43. An apparatus for removing material from a longitudinally extending workpiece, said apparatus comprising:

first and second carriages disposed adjacent to opposite sides of the workpiece;

a first plurality of rotatable brushes mounted on said first carriage;

a second plurality of rotatable brushes mounted on said second carriage;

a carriage drive mechanism which is operable to simultaneously move said first and second carriages toward the workpiece and to interrupt movement of said first and second carriages toward the workpiece with the first and second pluralities of brushes pressing against the workpiece with equal force, said carriage drive mechanism includes a motor means for effecting operation of said carriage drive mechanism to simultaneously move said first and second carriages toward the workpiece, and a control circuit for controlling operation of said motor means to cause said first and second pluralities of brushes to press against the workpiece with equal force, said control circuit including detector means for detecting the force with which said first and second pluralities of brushes press against the workpiece.

44. An apparatus as set forth in claim 43 wherein said brushes of said first plurality of brushes are rotatable about a plurality of axes extending parallel to a longitudinal central axis of said workpiece, said brushes of said second plurality of brushes are rotatable about a plurality of axes extending parallel to the longitudinal central axis of the workpiece, said carriage drive mechanism being operable to move said brushes of said first plurality of brushes along a path extending perpendicular to the axes about which said brushes of said first plurality of brushes rotate to change the positions of said brushes of said first plurality of brushes relative to the workpiece, said carriage drive mechanism being operable to move said brushes of said second plurality of brushes along a path extending perpendicular to the axes about which said second plurality of brushes rotate to change the positions of said brushes of said second plurality of brushes relative to the workpiece.

45. An apparatus as set forth in claim 43 further including a detector which is operable to detect a predetermined amount of brush wear and to effect operation of said carriage drive mechanism to simultaneously move said first and second carriages away from the workpiece to move said first and second pluralities of rotatable brushes from a condition engaging the workpiece to a condition spaced from the workpiece in response to said detector detecting the predetermined amount of brush wear.

46. An apparatus as set forth in claim 43 further including a first motor mounted on said first carriage and operable to rotate said first plurality of brushes, a second motor mounted on said second carriage and operable to rotate said second plurality of brushes, an electric current sensor which is connected with at least one of said first and second motors and is operable to detect a change in current conducted to at least said one of said first and second motors during operation of said first and second motors to rotate said first and second pluralities of brushes, said carriage drive mechanism being operable to simultaneously move said first and second carriages to change the positions of said first and second pluralities of brushes relative to the workpiece in response to said electric current sensor detecting an change in the current conducted to at least said one of said first and second motors during operation of said first and second motors to rotate said first and second pluralities of brushes.

47. An apparatus as set forth in claim 43 wherein said first plurality of brushes includes first and second brushes which are rotatable in opposite directions about a first axis which extends parallel to a longitudinal central axis of the workpiece, said first plurality of brushes further includes third and fourth brushes which are rotatable in opposite directions about a second axis which extends parallel to said first axis, said second plurality of brushes includes fifth and sixth brushes which are rotatable in opposite directions about a third axis which extends parallel to a longitudinal central axis of the workpiece, said second plurality of brushes further includes seventh and eighth brushes which are rotatable in opposite directions about a fourth axis which extends parallel to said third axis.

* * * * *